US006080061A

United States Patent [19]

Watanabe et al.

[11] Patent Number: 6,080,061

[45] Date of Patent: Jun. 27, 2000

[54] GAME MACHINE FOR RANDOMLY SELECTED INFORMATION COMPARISON WITH SETS OF SELECTED, RANDOMLY SELECTED AND CORRELATED INFORMATION

[75] Inventors: Katsuhiko Watanabe, Zama; Masanori Suganuma, Yokohama; Yoshihito Kato; Takashi Yamaguchi, both of Zama; So Takeyama, Yokohama; Hayato Mizue, Ebina, all of Japan

[73] Assignee: Konami Co., Ltd., Hyogo-ken, Japan

[21] Appl. No.: 08/923,078

[22] Filed: Sep. 3, 1997

[30] Foreign Application Priority Data

Sep. 5, 1996 [JP] Japan ..... 8-234876

[51] Int. Cl.[7] ..... A63F 3/06

[52] U.S. Cl. ..... 463/16; 273/144 R

[58] Field of Search ..... 463/16–19, 22, 463/25–28, 40–42; 273/138.1, 138.2, 148 R, 269, 237, 144 R

[56] References Cited

U.S. PATENT DOCUMENTS

| | | | |
|---|---|---|---|
| 4,798,387 | 1/1989 | Richardson | 273/237 |
| 5,127,651 | 7/1992 | Okada | 273/143 R |
| 5,401,024 | 3/1995 | Simunek | 273/269 |
| 5,624,119 | 4/1997 | Leake | 273/269 |
| 5,755,619 | 5/1998 | Matsumoto et al. | 463/19 |

FOREIGN PATENT DOCUMENTS

| | | |
|---|---|---|
| 702986 | 3/1996 | European Pat. Off. . |
| 826400 | 3/1998 | European Pat. Off. . |
| 3717593 | 12/1988 | Germany . |
| 4164470 | 6/1992 | Japan . |
| 712190 | 2/1995 | Japan . |
| 7178249 | 7/1995 | Japan . |
| 2287891 | 10/1995 | United Kingdom . |

*Primary Examiner*—Jessica J. Harrison
*Assistant Examiner*—Sheila Clayton
*Attorney, Agent, or Firm*—Jordan and Hamburg LLP

[57] ABSTRACT

A video game machine has a mechanism extracting balls, a display unit having a display area which displays a matrix composed of boxes, and a CPU. The CPU implements a function enabling the player to appoint a ball type in terms of color and number to boxes of a second line of the matrix. A function is provided for automatically displaying, in the first and third lines of the matrix, ball marks correlated to the ball marks displayed in the second line, such that the color sequences of the ball marks in the first and third lines are the same as that in the second line and such that numerals greater and smaller by one than a numeral in a box of the second line appear in the third and the first lines in each column of the matrix. Further provided is a function for determining whether or not the numeral of the extracted ball coincides with the numeral of any ball mark on the display and a function for changing the mode of display of the box having the coincident numeral. Also provided is a function for determining whether any line, column or oblique diagonal line of the matrix is completed by boxes displayed in the changed display mode. Finally, a function is implemented for instructing the machine to pay medals when any line is completed.

13 Claims, 28 Drawing Sheets

GAME MACHINE FOR RANDOMLY SELECTED INFORMATION COMPARISON WITH SETS OF SELECTED, RANDOMLY SELECTED AND CORRELATED INFORMATION

BACKGROUND OF THE INVENTION

1. Field of the Invention

The present invention relates to a video game machine in which a specific number of pieces of objects are extracted at random from among a certain number of pieces of object each having specific information peculiar thereto and, when the information gathered from the extracted object pieces has relevancy to specific information displayed on a screen, scores are given in accordance with the degrees of the relevance.

2. Description of the Related Art

Hitherto, such a bingo game machine has been proposed as having a rotary cage for shuffling a plurality of balls therein, a ball hopper for receiving the shuffled balls, a ball receptacle for receiving the balls one by one from the ball hopper and allowing the received ball to drop, a detector for temporarily holding the ball and detecting a numeral carried by the ball, and a ball pool into which balls, after the detection of the numerals, are introduced through a conduit and pooled therein. The bingo game machine also has a game display which displays a bingo card having a matrix of predetermined numerals arranged in a random manner. Coincidence of the numerals detected from the balls with the numerals arranged on a vertical, horizontal or diagonal line of the bingo card is regarded as a "win". Different scores are set for different natures or degrees of the "win". A predetermined number of medals are paid to the player in accordance with the score on the "win" gained by the player. This type of bingo game machine is disclosed, for example, in Japanese Patent Laid-Open No. 6-71010.

In this known game machine, numerals are arranged in all boxes of the bingo card in a random manner, and the player can "win" only when coincidence is obtained between all the numerals set in the boxes and the numerals of the extracted balls. Thus, the known game machine of the type described has only limited diversity and, hence, is monotonous.

SUMMARY OF THE INVENTION

Accordingly, an object of the present invention is to provide a video game machine in which characteristic features are given to the arrays of specific information displayed on the screen, so as to enhance variety and fun of the game.

To this end, in accordance with a first aspect of the present invention, there is provided a video game machine in which a specific number of pieces of objects are extracted at random from among a certain number of pieces of object each having specific information peculiar thereto and, when the information obtained from the extracted object pieces has relevancy to specific information displayed on a screen, scores are given in accordance with the degrees of the relevance, the video game machine comprising:

a matrix displaying means for displaying a matrix of boxes on the screen; input displaying means for enabling the player to arbitrarily allocate object marks having information peculiar thereto to respective boxes of a preselected line of the matrix, and for displaying the object marks in the respective boxes of the preselected line; automatic displaying means for automatically displaying, in the boxes of the remainder lines of the matrix, object marks each carrying information peculiar thereto and relevant to the information of the object mark set in the corresponding box of the preselected line by the input displaying means; first determining means for determining whether or not the information peculiar to the extracted ball coincide with that of any of the object marks displayed on the screen; display mode changing means for changing the mode of display only for the object marks with which the coincidence of information has been obtained; second determining means for determining whether or not the object marks displayed in the changed display mode complete any line of boxes of the matrix; and scoring means for giving a score when any one line has been completed with the object marks displayed in the changed display mode.

According to this arrangement, a plurality of pieces of peculiar information can be displayed in the form of a matrix on the screen. The player can input any desired pieces of information to the boxes of a desired preselected line of the matrix. Upon completion of the input of such pieces of information, other pieces of peculiar information relevant to those set in the preselected line are automatically set and displayed in the other lines of the matrix. Pieces of peculiar information are extracted one by one in a random manner, and are checked up with the pieces of information set and displayed in the matrix. The check up of the peculiar information is conducted not only with the pieces of peculiar information arbitrarily input to the preselected line by the player but also with those which have been automatically set in other lines. It is thus possible to have a greater number of checkup objects with minimal inputting operation. Namely, the peculiar information extracted by the game machine is compared with all the pieces of information displayed on the screen, and any coincident peculiar information is displayed in a different display mode, so as to inform the player of the fact of coincidence. When any one line is completed with such coincident pieces of information, a scoring operation is conducted to determine the number of the medals to be paid.

In accordance with a second aspect of the present invention, the video game machine further comprises means for displaying, on the screen, statistic data concerning the information extracted in previous plays of the game. The player can grasp, by making reference to the displayed statistic data, any tendency of extraction possessed by the game machine, so that the player can take an advantage in proceeding with the game.

In accordance with a third aspect of the present invention, there is provided a video game machine in which a specific number of pieces of objects are extracted at random from among a certain number of pieces of object each having specific information peculiar thereto and, when the information obtained from the extracted object pieces has relevancy to specific information displayed on a screen, scores are given in accordance with the degrees of the relevance, the video game machine comprising: bingo card displaying for displaying on the screen one or more bingo cards each having n pieces of boxes arranged in the form of a matrix by allocating arbitrary peculiar information to (n–m) pieces of boxes and a predetermined mark to m pieces of boxes; first determining means for determining whether the information peculiar to the extracted object coincides with any of the information in the (n–m) boxes of the displayed matrix; display mode changing means for changing the mode of display of the boxes having peculiar information coincident to the peculiar information of the extracted object; second determining means for determining whether or not there is any line of boxes of the matrix in which all the boxes are displayed in the changed display mode, regardless of whether any box of the line includes a box having the predetermined mark; and scoring means which, when there is a line in which all the boxes are displayed in the changed display mode, entitles the player to a win.

According to this arrangement, not all the boxes of each bingo card are filled with pieces of peculiar information. Namely, a predetermined mark is allocated to some of the boxes of the matrix on the bingo card. The player wins when any line is completed by boxes having coincident pieces of peculiar information, regardless of whether such line contains the abovementioned predetermined mark. Thus, the predetermined mark is regarded as being "coincident" or "hit", so that the degree of difficulty in achieving bingo can be varied depending on the pattern of distribution of the predetermined mark, thus enhancing the fun of the game. In addition, the types of the bingo cards can be diversified by varying the pattern of the predetermined mark. This makes it possible to prepare a greater number of types of bingo cards, which in turn minimizes the possibility that the same type of bingo cards are repeatedly displayed.

In accordance with a fourth aspect of the present invention, there is provided a video game machine in which a specific number of pieces of objects are extracted at random from among a certain number of pieces of object each having specific information peculiar thereto and, when the information obtained from the extracted object pieces has relevancy to specific information displayed on a screen, scores are given in accordance with the degrees of the relevance, the video game comprising: displaying function for displaying a plurality of boxes which are arranged in side-by-side in one direction and arrayed along lines which are perpendicular to the direction, while allocating in a random manner a plurality of pieces of peculiar information to these boxes; first determining means for determining whether the peculiar information obtained from the extracted object coincides with any of the peculiar information displayed in the boxes; shift display means which, when there is any box having the coincident information, performs shifting of all the displayed pieces of information which are in the same line as the coincident information and which are arrayed in one direction from the coincident information, such that the pieces information as a whole move along the line in the direction opposite to the one direction by an amount corresponding to the number of the boxes having the coincident information in the line, so that blank boxes of a number corresponding to the number of boxes having the coincident information are left in the line as a result of the shifting of the pieces of peculiar information on display; second determining means which determines whether or not there is a line in which all the boxes have been changed into blank boxes; and scoring function which regards any line in which all the boxes have been turned to blank as being a "win".

According to this arrangement, when a line has a piece of peculiar information coincident to the extracted piece of information, all the pieces of information, which are displayed in the same line as the coincident information and which are arrayed in one direction from the coincident information, are shifted along the line in the direction opposite to the abovementioned one direction, so that blank boxes of a number corresponding to the number of boxes having the coincident information are left in the line. When all the pieces of information in a line have been coincided with the pieces of information carried by the extracted objects, all the boxes are turned to blanks in this line, so that the player gains a score.

In accordance with the fifth aspect of the invention, a video game machine in which a specific number of pieces of objects are extracted at random from among a certain number of pieces of object each having specific information peculiar thereto and, when the information obtained from the extracted object pieces has relevancy to specific information displayed on a screen, scores are given in accordance with the degrees of the relevance, the video game comprising: mark displaying means for displaying predetermined marks in a plurality of boxes which are arranged side-by-side in one direction and arrayed in lines perpendicular to the direction; peculiar information displaying function for displaying for each of the lines an arbitrary number (from 1 to m) of pieces of peculiar information which have been selected in a random manner; first-place inputting function by which a player appoints one of the lines which the player forecasts to win the first place; first determining means which determines whether or not there is any line having a box containing a piece of peculiar information coincident to the peculiar information obtained from the extracted object; stepwise displaying means for adding one piece of the predetermined mark in the line having the coincident peculiar information, starting from one end towards the other end of the line on display; first-place detecting means for detecting the line in which the number of the displayed predetermined marks has reached a predetermined number, prior to other lines; second determining means which determines whether or not the line detected by the first-place detecting means coincides with the line which the player has forecast and appointed as being the first-place winner by the first-place inputting means; and scoring means for providing a score when coincidence of the lines is determined by the second determining means.

According to this arrangement, the piece of information obtained from the extracted object is checked up for coincidence with the pieces of peculiar information set and displayed for each line and one piece of the predetermined mark is additionally displayed in any line which has the coincident piece of information. Consequently, the number of the pieces of the predetermined mark increases progressively in accordance with the increase in the number of coincident piece of information. The line in which a predetermined number is reached earlier than other lines is regarded as being the first-place winner. If this line coincides with the line which has been forecast by the player as being the first-place winner, a score is given to the player.

In accordance with the sixth aspect of the invention, the information peculiar to each the object is a combination of a numeral and a color. The use of such combinations enhances the complexity and diversity of the conditions for coincidence, as compared with the case where only one type of attribute is employed. For instance, the coincidence between the peculiar information displayed on the screen and the peculiar information obtained from the extracted object may be determined on condition that both the numeral and color of both pieces of information are the same, or coincidence may be determined based on the identity of the numeral alone. It is also possible that the coincidence is determined based on the numerals alone and additional score is given when coincidence is obtained also in regard to the color. It is thus possible to diversify the nature of the game.

According to a seventh aspect of the invention, the video game machine further comprises bet input means for enabling the player to input predetermined number of bets by using icons displayed on the screen including an icon indicative of a first bet unit to be input and an icon indicative of a second bit unit to be input, wherein the scoring means provides different scores depending on the number of bets input through the bet input means. The use of different input bet units permits easy and quicker input of the bet number, as compared with the case where only one bet input unit is used. This advantage is remarkable particularly when a large number of the bets are to be placed.

In accordance with an eighth aspect, the first bit unit comprises one bet and the second bet unit comprises five bets. For instance, 11 bets can be input only by three input operations.

The above and other objects, features and advantages of the present invention will become clear from the following description of the preferred embodiments taken in conjunction with the accompanying drawings.

DESCRIPTION OF THE PREFERRED EMBODIMENT

Figure 1:
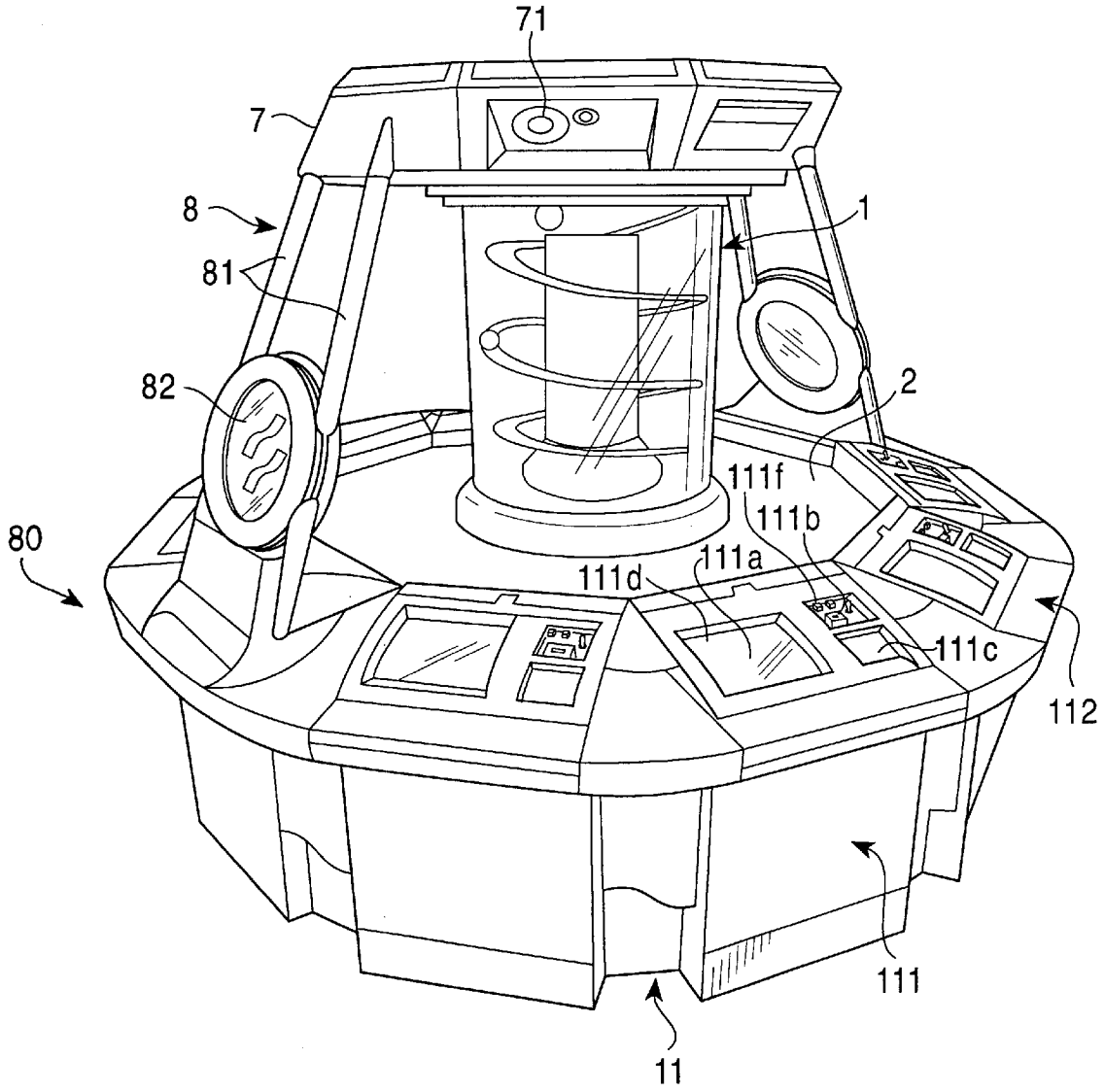
FIG. 1 is a perspective view of a game machine in accordance with the present invention.
Figure 2:
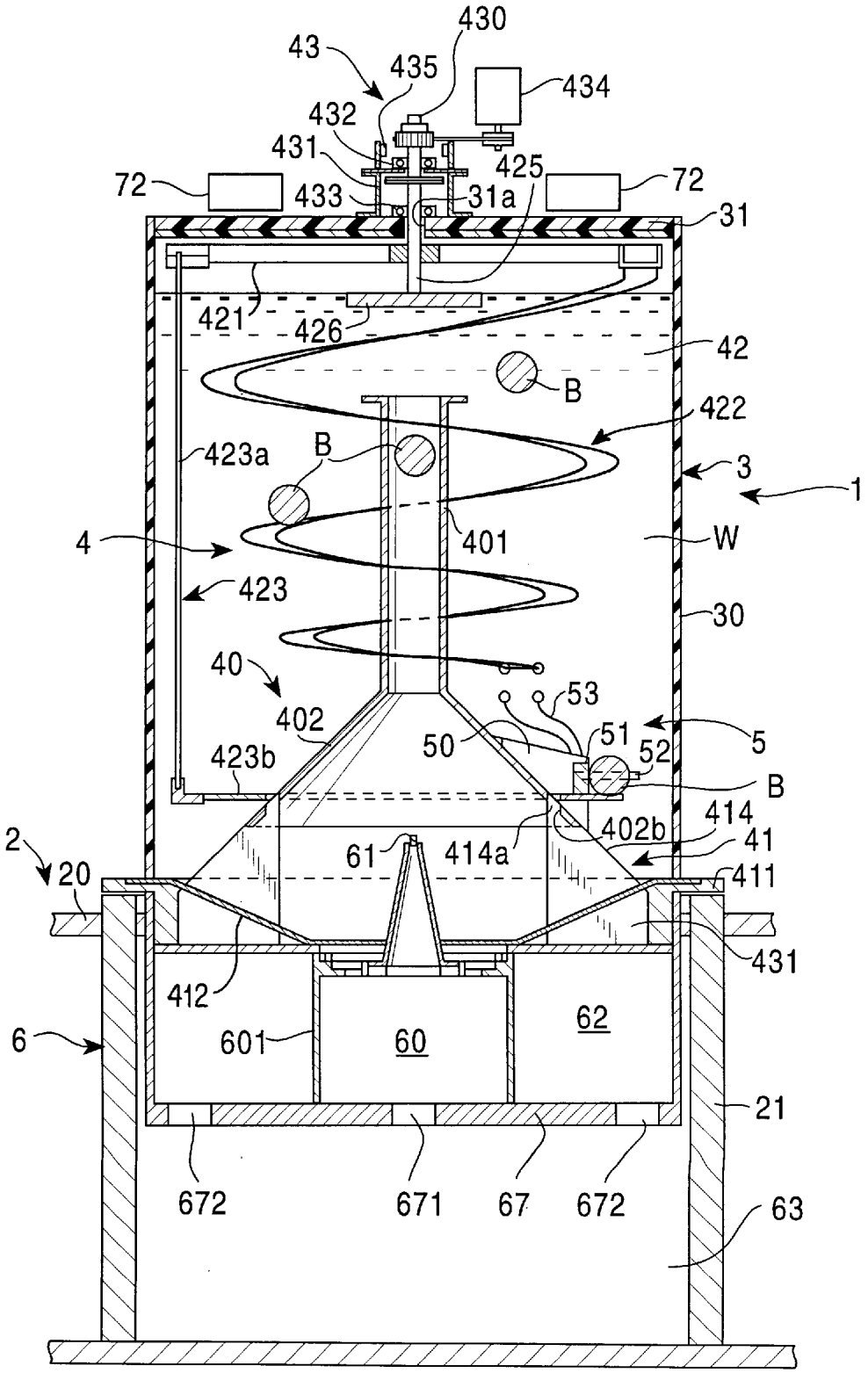
FIG. 2 is a schematic front elevational view of a mechanical section of the game machine.

FIG. 1 is a schematic perspective view of a game machine in accordance with the present invention, while FIG. 2 is a front elevational view of a mechanical section of the game machine, schematically illustrating the construction of the mechanical section. The illustrated game machine, which is usable as a bingo game machine, has a central mechanical section 1 and a peripheral input section 11. Although FIG. 1 shows only front side of the machine, the whole machine has an identical arrangement both at its front and rear sides. The game machine also employs a predetermined number of balls B.

Figure 6:
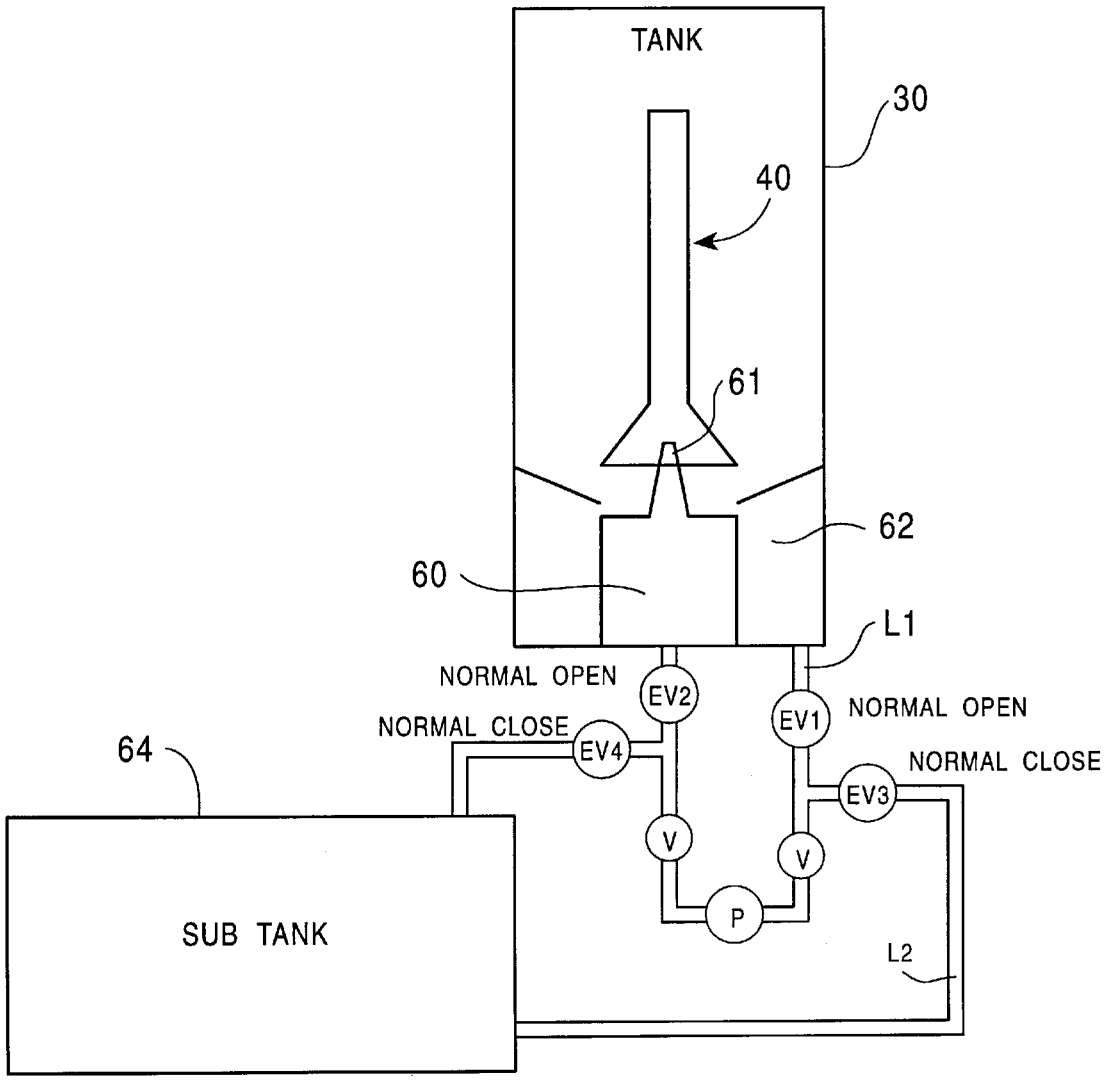
FIG. 6 is a piping diagram showing the piping of the liquid supply portion.

As will be seen from FIG. 2, the mechanical section 1 has a base portion 2, a central portion 3 standing upright from the top center of the base portion 2, a crown portion 7 serving as a ceiling of the central portion 3, and left and right support portions 8. The top face of the base portion 2 has a flat annular area which is made of, for example, a plate member which provides a white flat surface 20. A sub-tank 64 is disposed inside the base portion 2 as shown in FIG. 6. The central portion 3 has a cylindrical tank 30 which contains a predetermined quantity of a liquid having a specific gravity smaller than that of the ball B, e.g., water W. A shuffling portion 4 for creating circulation of the liquid and a reading portion 5 for reading information peculiar to the ball B are disposed inside the tank 30. Although not shown in FIG. 1, a liquid supply portion 6 (see FIG. 2) is disposed under the tank 30. Conduits L1, L2, a pump P, and electromagnetic or solenoid valves EV1 to EV4 (see FIG. 6), which in cooperation constitute the liquid supply portion 6, are arranged in the remainder part of the space inside the base portion 2.

The crown portion 7 provided on the top of the tank 30 has a substantial diameter, and carries visual information such as words expressing the contents of the game, as well as a speaker 71 which produces a certain type of acoustic effect. As will be described later, a driving unit 43, which constitutes a part of the shuffling mechanism 4, is disposed at the center of the crown portion 7. A plurality of tank interior lighting portions 72 are disposed at an inner peripheral part of the crown portion 7 at a constant circumferential spacing. In the illustrated embodiment, there are three lighting portions 72 which emits light beams of three primary colors.

Each support 8 has a bed 80 which is disposed at a left or right side portion of the base portion 2, a pair of parallel arms 81 which are fixed to the bed 80 and the crown 7, and an illuminating portion 82 fixed to the parallel arms 81. Light projecting units 9 are attached to the lower side of the crown portion 7 both at left and right side portions of the same, so as to apply beams of light to the aforementioned annular flat white surface 20 in a manner like searchlights, as will be described later.

The input section 11 surrounds the base portion 2 and has a plurality of game terminals 111, 112 and so on arranged in a symmetrical manner. In the illustrated embodiment, four terminals are arranged on the front side and four on the rear side of the game machine. All these terminals have an identical construction.

The construction of the terminal will be described with reference to the terminal 111 by way of example. The terminal 111 has a display portion 111*a* constituted by, for example, a CRT for displaying various kinds of information such as the content of the game, operation menu and so forth, a medal supply portion 111*b* adjacent to the display portion 111*a* and a medal payoff portion 111*c* under the medal supply portion 111*b*. The arrangement is such that predetermined numbers of medals are paid to the player in accordance with the scores gained in the game. Predetermined numbers of medals, corresponding to the scores gained, are counted by a payoff unit (not shown) inside the machine and are paid from a medal box (not shown) inside the machine.

A game format such as of a bingo card is electronically displayed on the display portion 111*a* which also gives information and instructions necessary for prosecuting the game by means of menus. The player can make a direct access to the menu through a transparent touch panel 111*d* superposed on the display portion 111*a*.

The touch panel 111*d* is a two-dimensional tabular device having an X-Y plane and made of a material which permits supersonic wave to propagate therethrough. A supersonic wave generator is arranged along one of two sides parallel to the X-axis so as to cyclically transmit supersonic wave towards the other side. Similarly, a supersonic wave generator is disposed along one of opposing sides parallel to the Y-axis so as to cyclically transmit supersonic wave towards the opposing side. When a player's finger touches at an appropriate portion of the panel, the supersonic wave is reflected at the position touched by the finger, so that the position of the finger touching the panel can be located on the X-Y coordinates by calculating the time until the reflected supersonic waves reach respective supersonic generators. The coordinates of the position of the finger touch and the coordinates of the menu is suitably correlated, so that the machine understands what portion or item on the display has been selected by the player.

FIG. 2 is a front elevational view of the mechanical section 1, schematically illustrating the construction thereof. The shuffling portion 4 has a tubular structure 40, an annular support 41 in support of the tubular structure 40, a sinking ball guide portion 42 between the tubular structure 40 and the tank 30, and the driving unit 43 for rotating the sinking ball guide portion 42.

The tubular structure 40 has an upper part constituted by a cylindrical passage portion 401, and a lower part constituted by a frusto-conical return portion 402. These upper and lower parts may be formed integrally, or may be formed separately and then united such that a cylindrical hub 402*a* (see FIG. 4) on the upper end of the return portion 402 fits in the passage portion 401.

The annular support 41 includes an annular member 411 which is fixed to the upper ends of a predetermined number of pillars 21 arranged along a circle and standing upright inside the base portion 2 and which carries the tank 30, a slant surface 412 which spreads radially inward from the annular member 411, a plurality of reinforcement ribs arranged radially on the lower side of the annular member 411 so as to reinforce the latter; and a plurality of supporting ribs 414 standing upright from the slant surface 412. The slant surface has an inside diameter as measured at its bottom which is about ⅓ the inside diameter of the tank 30. The supporting ribs 414 have slant sides which are substantially flush with the slant surface of the return portion 402. Projections 414*a* formed on the upper ends of the supporting ribs 414 engage with corresponding anchor holes 402*b* formed in the return portion 402, whereby the tubular structure 40 is supported by the supporting ribs 414. A clearance of a size which is large enough to allow the ball B to pass therethrough is defined between the lower end edge of the return portion 402 of the tubular portion 40 and the slant surface 412 of the annular support 41. A predetermined number of balls B can be accommodated in a space defined by the shapes of the return portion 402 and the slant surface 412, as well as by the size of the clearance between them.

The upper end opening of the tank 30 is closed by a cover 31 which is constituted by a single sheet of glass or an acrylic resin or by a laminate structure composed of such a glass or acrylic resin sheet and another acrylic resin sheet superposed on the center of the first-mentioned sheet where the driving unit 43 is mounted. The driving unit 43 has a rotary shaft 430 which extends through a shaft hole 31*a* formed in the center of the cover 31. The driving unit 43 has, besides the rotary shaft 430, various components such as a supporting tube 431, upper and lower bearings 432, 433 which respectively support the upper and lower portions of the rotary shaft 430, and a motor 434 which drives the rotary shaft 430 through, for example, a belt transmission. The driving unit 43 also has a pair of rotation angle sensors 435 which are operative to sense the angle of rotation of the rotary shaft 430 to control the rotation. Each rotation angle sensor 435 includes, for example, a photo-interrupter which detects passage of a radial projection projecting from a suitable portion of the rotary shaft 430. These sensors 435 are arranged to diametrically oppose each other and perform monitoring of the rotation direction.

A horizontal rotation arm 421 is fixed to the lower end of the rotary shaft 430 for rotation therewith. A spiral guide rail 422 composed of a pair of coaxial spiral pipes is attached to one end of the rotation arm 421, while a gate member 423 depends from the other end of the rotary arm 421. The distance between the pair of pipes constituting the guide rail 422 is somewhat smaller than the diameter of the ball B, so that the ball B can "sink" while rolling along the guide rail 422. The diameter of the spiral guide rail 422 progressively decreases towards the lower end, such that the diameter of a turn of the spiral form is smaller than that of the overlying turn by an amount which is substantially equal to the gap between the pair of pipes. Such a progressive change of the spiral diameter maximizes the chance for the sinking ball to be caught by a portion of the spiral guide rail 422. The lower end of the guide rail 422 is positioned at a level which is just above the level of the reading portion 5 disposed on a suitable portion of the slant surface of the return portion 402, so that, as will be described later, a ball B leaving the lower end of the guide rail 422 passes through a reading position in the reading portion 5, whereby the ball B is "extracted".

The guide rail 422 is driven by the driving unit 43 to rotate at a period of several seconds to ten and several seconds, and the ball B is allowed to enter the reading portion 5 to pass through the reading position only when the timing at which the ball B leaves the lower end of the guide rail 422 coincides with the timing at which the lower end of the guide rail 422 opposes the reading portion 5. Although the diameter of the spiral guide rail 422 progressively decreases downward, this is not exclusive and the spiral guide rail may have a diameter which progressively increases towards the lower end.

Figure 3:
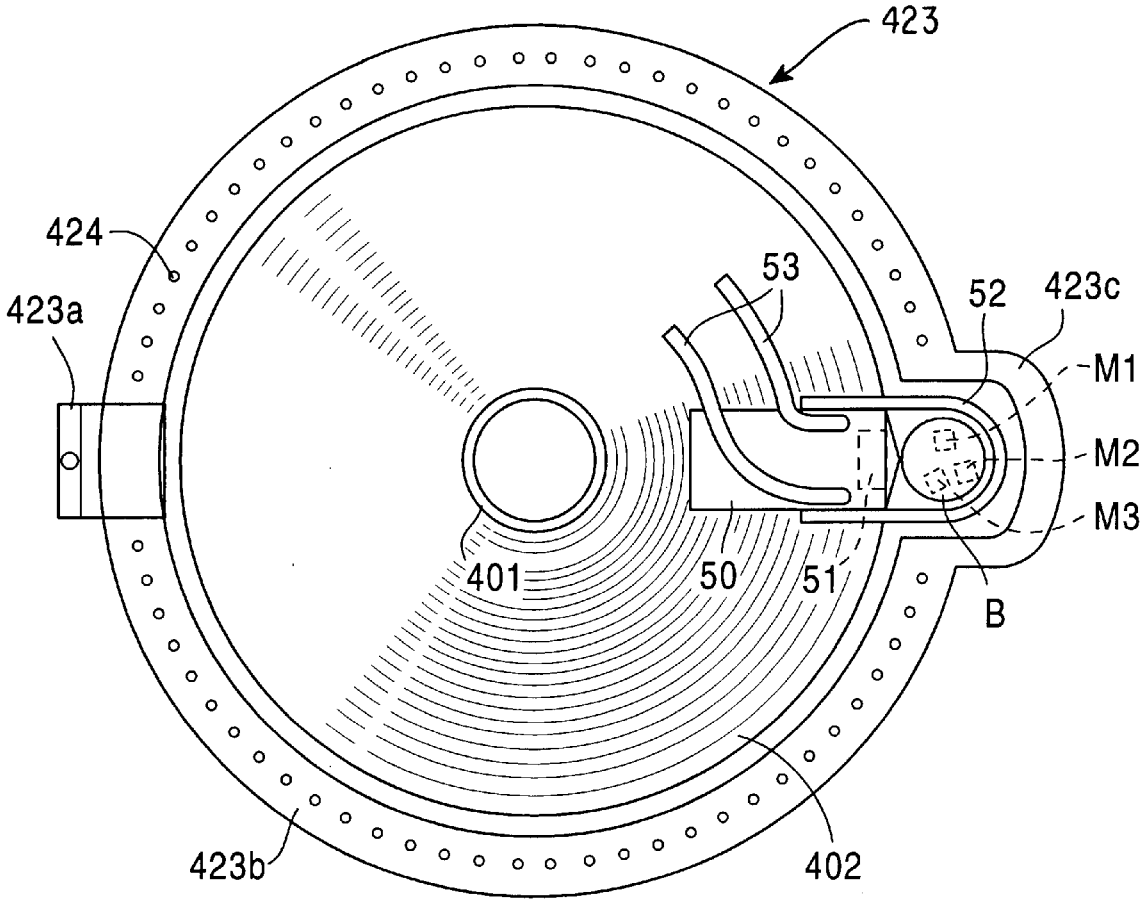
FIG. 3 is a plan view of a reading portion of the game machine.
Figure 4:
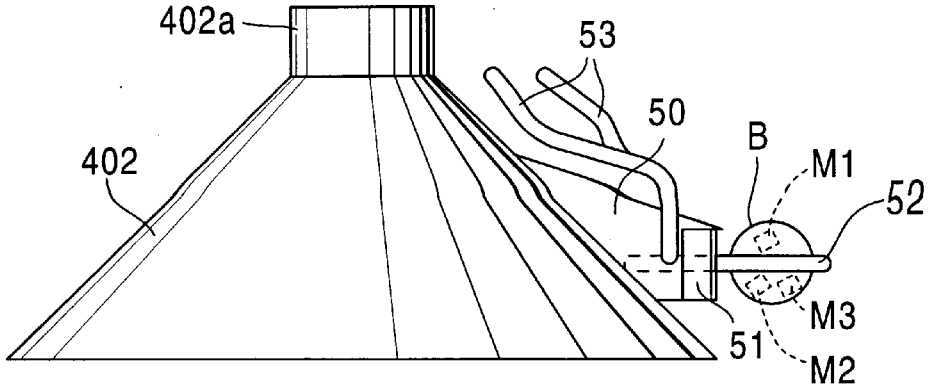
FIG. 4 is a side view of the reading portion.

As will be seen from FIGS. 3 and 4, the reading portion 5 includes a sensor body 50, a sensor element 51 and a ring 52 provided on the sensor body 50, the sensor ring 52 being horizontally oriented and having a diameter greater than that of the ball B, at the smallest. The sensor element 51 may be a magnetic sensor sensitive to magnetism, which includes a reading coil which is disposed to oppose the ring 52 and which serves as a magnetic head. When a ball B has been extracted, i.e., when a ball B passes through the ring 52, the sensor element 51 works as a proximity sensor which senses magnetic codes produced by magnetic code generating members M1, M2 and M3 embedded in the ball B. More specifically, these three magnetic code generating members M1, M2 and M3 are arranged to extend in three directions which are orthogonal to one another and produce magnetic codes in the directions of their axes in synchronization, thus realizing magnetic anisotropy or non-directivity of the ball. In the illustrated embodiments, balls of three different colors are used, 10 balls for each color. The magnetic code generating members M1 to M3 embedded in each ball B generate a code corresponding to the color of the ball, e.g., red, blue or yellow, and a code corresponding to numeral, e.g., one of numbers from 0 to 9. Thus, the sensor element 51 is capable of sensing the magnetic codes generated by one of the three code generating members M1 to M3, regardless of the posture of the ball B passing through the ring 52 and serves as proximity sensor which reads the information carried by the codes. Consequently, the construction for reading information is much more simplified as compared with the case where the ball is held mechanically and read by a code reader after the ball posture is verified.

The reading portion 5 further has a receiving guide 53 disposed above the sensor body 50. The receiving guide 53 is composed of a pair of pipes which are arranged side by side leaving therebetween a gap which is slightly smaller than the diameter of the ball B. These pipes have their upper ends disposed at a level just below the locus of the rotation of the guide rail 422. When a ball B leaves the lower end of the guide rail 422 while the latter has just been rotated to oppose the upper end of the receiving guide 53, the ball B is received by the receiving guide 53 to roll therealong into the ring 52.

A gate member 423 which depends from the rotary arm 421 has a vertical arm 423*a* and the above-mentioned horizontal annular gate plate 423*b* secured to the vertical arm 423*a*. The lower end of the vertical arm 423*a* is set at a level which is lower by a half diameter of the ball B than the level of the ring 52. As will be seen from FIG. 3, the gate plate 423*b* has a C-shape which is formed by cutting a circumferential part out of an annular member by a length equal to or slightly greater than the diameter of the ring 52. Thus, the gate plate 423*b* prevents the ball B received in the ring 52 from sinking, so that the ball B is temporarily held in the ring 52 for a certain period during which the magnetic codes of the ball B are read. As a result of rotation of the gate plate 423*b*, the cutout portion of the gate plate 423*b* is brought to a position right below the ring 52 to allow the ball B to fall. The size of the cutout portion is determined to be large enough to permit the ball B to pass through the cutout portion which is being rotated. The portion of the gate plate 423*b* other than the cutout portion serves to hold the ball B for a predetermined period of time to prevent any subsequent ball B released from the end of the guide rail 422 from being extracted, thus offering random nature of ball extraction, while minimizing a chance for any ball B sinking downward by the force of gravity without rolling along the guide rail 422 to directly fall into the ring for extraction, thus enhancing the fun of the game.

Although the illustrated embodiment has only one reading portion 5, this is only illustrative and the game machine of the invention may have two symmetrically arranged reading portions or three or more reading portions arranged preferably at a constant circumferential pitch. It is not essential that such a plurality of reading portions 5 are arranged symmetrically or at a constant circumferential pitch. However, reading portions 5 which are arranged in close proximity to each other increase the chance that successive balls B rolling down along the guide rail 22 are successively extracted by these reading portions 5, thus impairing the random nature of the ball selection. The use of a plurality of reading portions 5 realizes distribution of the positions of ball extraction, thus enhancing the random nature of the ball selection and rendering the game more interesting, while giving a stimulating effect to the play.

The rotary shaft 430, rotary arm 421 and the gate member 424 have a continuous bore or conduit formed therethrough which opens in a plurality of tiny holes 424 perforated in the upper face of the gate plate 423*b*. Compressed air is supplied into the conduit from an air compressor (not shown) having a compressed air outlet connected to the upper end of the rotary shaft 430. The air is released from the tiny holes 424 of the gate plate 423*b* so as to form upward flow of tiny air bubbles. A plurality of tank interior lighting portions 72 are disposed right above the gate plate 423*b*. In the illustrated embodiment, four such tank interior lighting portions 72 are employed so that light beams of different colors, including white, are projected onto the upward flow of the air bubbles, thus giving a high stage effect.

Figure 5:
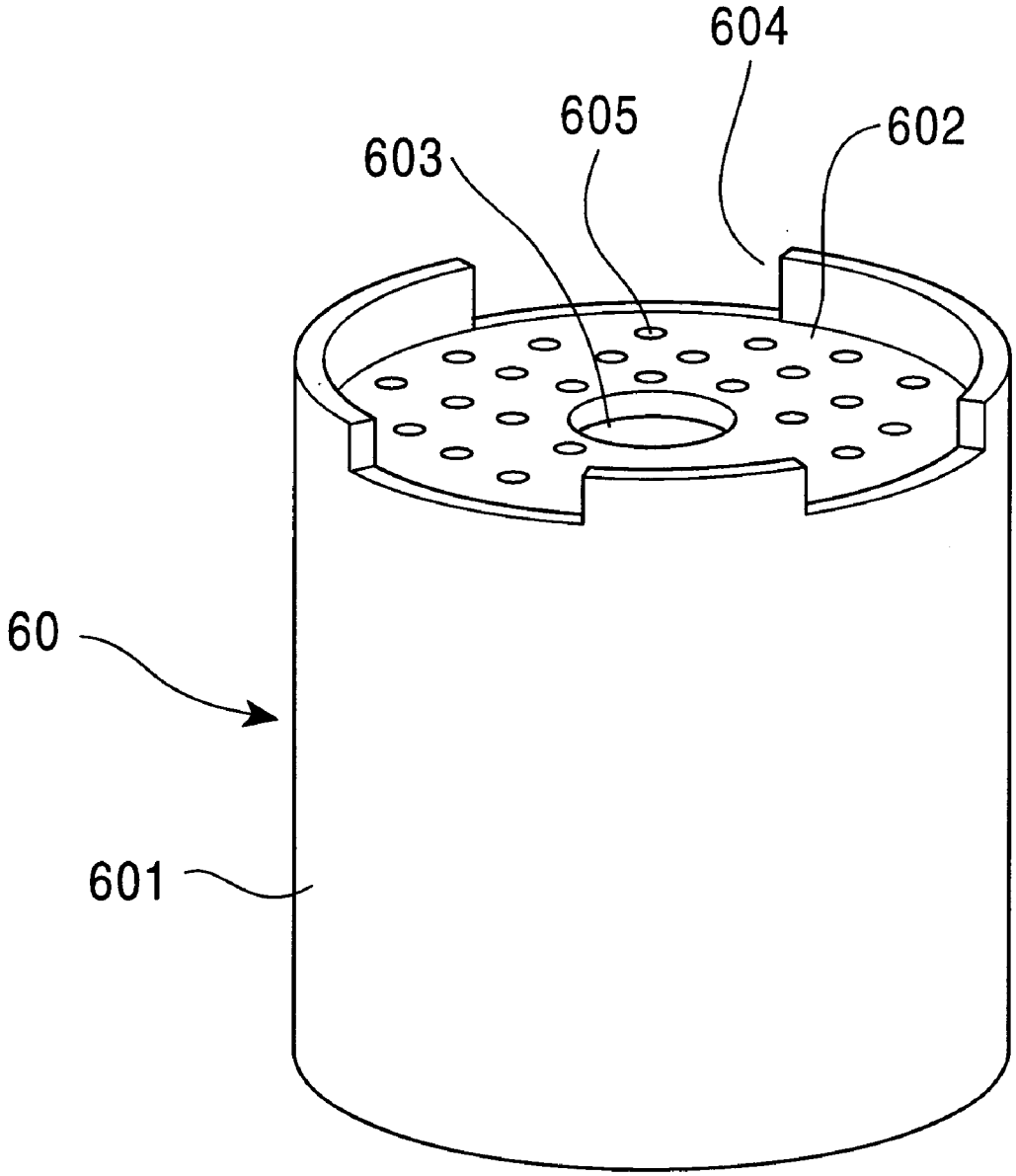
FIG. 5 is an illustration of the construction of a discharge tube of a liquid supply portion.

A description will now be given of the construction and operation of the liquid supply portion 6, with specific reference to FIGS. 2, 5 and 6. The liquid supply portion 6 is disposed below the slant surface 412, and has a discharge tube 60, a nozzle 61, a suction tube 62, and a liquid supply driving unit 63 which is shown in FIG. 6. Referring to FIG. 6, the liquid supply driving unit has a pump P, conduits L1, L2 and a plurality of solenoid valves EV1 to EV4, and is equipped with a sub-tank 64 having a capacity equal to or greater than that of the tank 30.

The liquid supply driving unit 63 is disposed in a lowermost space of the base section 2. The central discharge tube 60 and the suction tube 62 surrounding the discharge tube 60 are formed on a partition plate 67 disposed above the liquid supply driving unit 63. As shown in FIG. 5, the discharge tube has a ceiling 602 in which is formed a central hole 603. The peripheral cylindrical wall 601 extends upward beyond the ceiling 602 over a predetermined axial length. The extension of the peripheral wall 601 is cutout at suitable circumferential positions to provide a plurality of cutouts 604 each providing a predetermined opening area. The upper end brim of the extension of the peripheral wall of the discharge tube 60 abuts the lower surface of the radially innermost portion of the base plate 411 of the support 41. The peripheral wall 61 of the discharge tube 60 serves also as the inner peripheral wall of the suction tube 62. An upwardly converging nozzle 61 is attached to the ceiling 602 of the discharge tube 60 so as to cover the hole 603. The partition plate 67 has a central hole 671 and a pair of holes 672 formed at suitable portions in a peripheral region of the partition plate 67. According to this arrangement, the space around the nozzle 61 communicates through the cutouts 604 with the space in the suction tube 62 which in turn communicates with a liquid inlet of the liquid supply driving unit 63 through the peripheral holes 672. At the same time, an outlet of the liquid supply driving unit 63 communicates through the central hole 671 with the space inside the discharge tube 60 which in turn communicates with the space inside the nozzle 61 through the hole 603. In operation, water W delivered by the pump P into the discharge tube 60 is discharged from the nozzle 61 to form an upward flow of water W through the return portion 402 and the cylindrical passage portion 401. The upward flow of water W is freed from the upper end of the cylindrical passage portion 401 to diverge radially outward and then flows downward towards the cutouts 604.

The total area of the cutouts 604 is so determined that the water W passes through these cutouts 604 at a velocity which is smaller than the velocity of the upward flow of water from the nozzle 61, so that the downward flow of the water does not produce any substantial downward force which would act on the returning balls B. Balls which have fallen onto the ceiling 602 of the discharge tube 60 along with the flow of water are attracted by the upward flow of water created by the nozzle 61, whereby a circulation of balls B takes place through the sink passage between the tubular structure 40 and the wall of the tank 30. Water is discharged also through a plurality of small holes 605 formed around the central hole 603 at a constant radial distance from the center of the discharge tube 60, so that upward flow of water created by the water discharged from these small holes 65 serves to lift the balls B on the ceiling 602 to a level where the balls B are easily caught by the upward flow created by the nozzle 61, whereby stagnation of balls B on the ceiling 502 is avoided.

Referring specifically to FIG. 6, the liquid supply driving unit 63 has a conduit L1 which interconnects the hole 671 and the holes 672. The conduit L1 has the solenoid valve EV1, valve V, pump P, valve V and the solenoid valve EV2 disposed in the conduit L1 sequentially in the order from the end adjacent to the holes 672, i.e., from the upstream end, to the end adjacent to the hole 671, i.e., the downstream end. The liquid supply driving unit 63 also has a conduit L2 branching from a portion of the conduit L1 between the solenoid valve EV1 and the valve V and which leads to an inlet of the sub-tank 64. The conduit L2 also includes a portion which leads from an outlet of the sub-tank 64 and merges in the conduit L1 at a portion of the latter between the valve V and the solenoid valve EV2. The portion of the conduit L2 leading to the inlet of the sub-tank has the solenoid valve EV3, while the portion leading from the outlet of the tank 64 has the solenoid valve EV4. The pair of valves V in the conduit L1 are used for the purpose of regulating or adjusting the flow rate of the water during the playing.

During the playing, the solenoid valves EV1 and EV2 are opened, while the solenoid valves EV3 and EV4 are closed. As the pump P operates, water W circulates through the solenoid valve EV2, hole 671, inside the tank 30, holes 672 and then through the solenoid valve EV1.

Supply or draining of the liquid inside the machine for the purpose of maintenance or renewal of the liquid is conducted as follow. For the purpose of draining, the pump P is operated with the solenoid valves EV1 and EV4 kept opened and the solenoid valves EV2 and EV3 kept closed, so that the water W inside the tank 30 is displaced into the sub-tank 64 via the suction tube 62, holes 672, solenoid valve EV1, pump P and the solenoid valve EV4, whereby the tank 30 is drained to enable an efficient work inside the tank 30 for the purpose of, for example, maintenance. For the purpose of filling the machine with water again, the pump P is operated with the solenoid valves EV2 and EV3 opened and the solenoid valves EV1 and EV4 closed, so that the water W inside the sub-tank 64 is returned to the tank 30 via the solenoid valve EV3, pump P, solenoid valve EV2, holes 672, discharge tube 60, hole 603 and the nozzle 61.

A description will now be given of the operation for extracting the ball B, as well as of the operation for reading the magnetic codes. Thirty (30) balls are charged in the machine together with the predetermined quantity of water W. As the pump P starts to operate, upward flow of water is created through the nozzle 61 to cause the water to ascend through the tubular structure 40. At the same time, water is discharged also from the small holes 605 to lift the balls B stagnant on the ceiling 602 to the level of the outlet of the nozzle 61 and are caught by the upward flow of water from the nozzle so as to ascend through the tubular structure 40. The balls B which have been released from the upper end of the tubular structure 40 are conveyed radially by the flow of water which spreads radially outward towards the wall of the tank 30. The balls B then start to slowly sink due to a difference in the specific gravity. Sinking balls B picked up by the rotating guide rail 422, i.e., the balls which have fallen onto the guide rail 422, roll down along the guide rail 422 so as to be released from the lower end of the guide rail 422. The spiral form of the guide rail 422 and the slow speed of rotation of the same provides a large credibility that the sinking balls B fall onto the rotating guide rail 422. When the timing at which a ball B leaves the lower end of the guide rail 422 coincides with the timing at which the lower end of the rotating guide rail 422 is positioned right above the receiving guide 53, the ball B is introduced into the reading portion 5 so as to be extracted by being read. Balls B which leave the lower end of the guide rail 422 when the lower end of the guide rail 422 is out of alignment with the receiving guide 53 are allowed to roll down along the slant surface 412, without being extracted, and are lifted by the upward flow of water discharged from the small holes 605 to the level of the end of the nozzle 61, so as to be forced into the tubular structure 40 to circulate again through the described path of ball circulation. There are balls, although few, which fall down directly to the level of the reading portion 5 without being picked up by the rotating guide rail 422. These balls B also are circulated without being extracted, in the manner described above.

In contrast, the extracted ball B is held by the land portion of the gate plate 423*b* so as to stay in the ring 52 for a predetermined period of time, and the magnetic codes of the ball B are read by the sensor element 51 during the stay. The gate is opened as the gate plate 423 has been rotated to bring its cutout portion to the position right below the ring 52, so that the ball B falls towards the slant surface 412. Thus, the extracted ball B also is fed into the tubular structure 40 together with the balls B which have not been extracted. The described operation is continued until the pump P is stopped when the game is over, i.e., when a predetermined number of balls B have been extracted.

A description will now be given of the light projecting units 9, with specific reference to FIGS. 7 to 9. As will be seen from FIG. 7, the pair of light projecting units 9 are provided on the lower part of the head portion 7 at left and right portions of the latter, so as to project light beams onto the white flat surface of the base portion 2 in a manner like searchlights.

Figure 7:
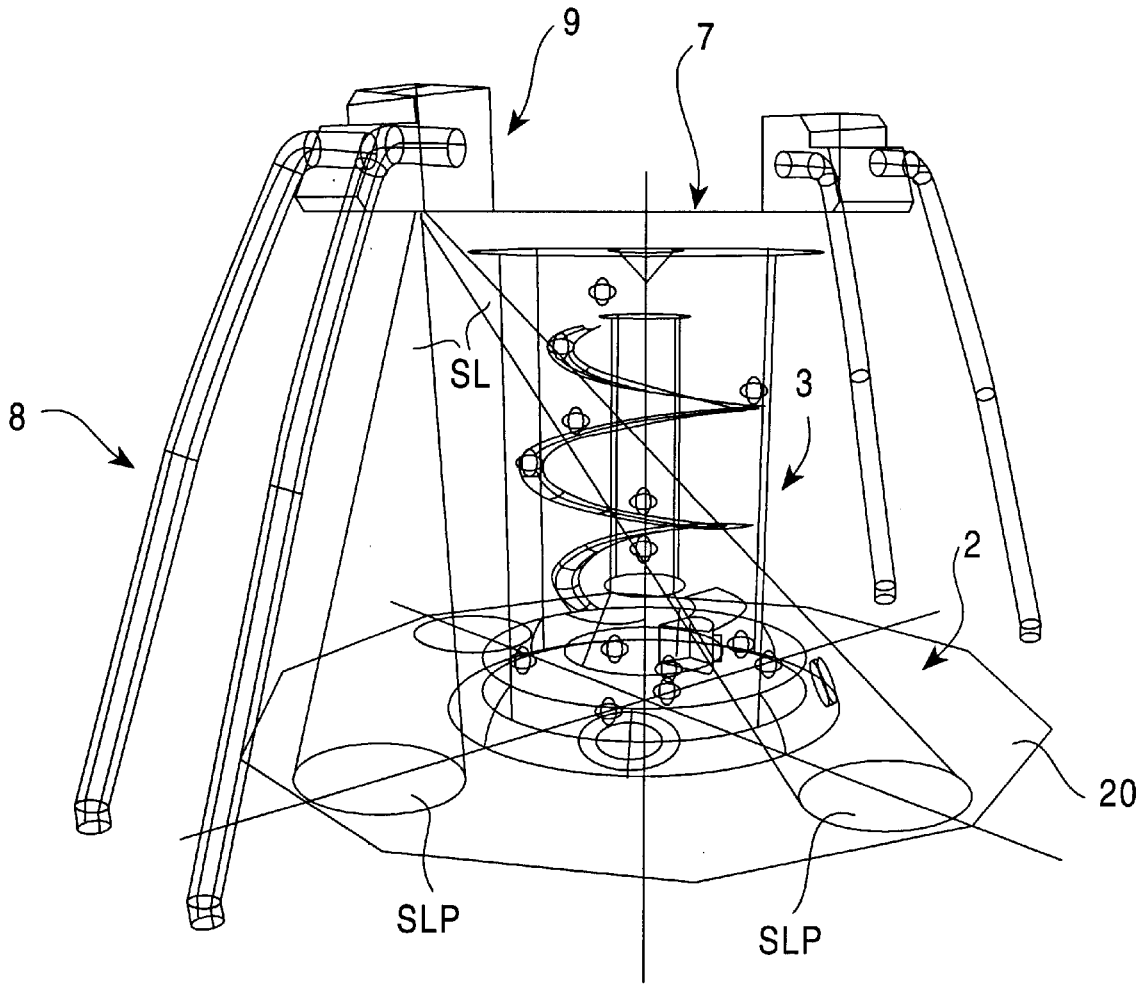
FIG. 7 is a schematic illustration of the game machine showing the positional relationships of a base portion, central structure, crown and light projecting units.

FIG. 7 schematically illustrates the positional relationships between the base portion 2, central portion 3, crown 7 and the light projecting units 9. One of the light projecting units 9 is attached to lower left side portion, while the other is attached to lower right side portion, of the crown 7. For the purpose of simplification of the drawings, only the left light projecting unit 9 is shown in FIG. 7. A spot light beam SL of a predetermined beam diameter is applied onto the annular white flat surface 20 on the base portion 2. The light projecting unit 9 has a swivel mechanism which swivels the unit 9 such that the position SLP of a spotlight SL oscillatorily or reciprocately moves along the annular white flat surface 20.

Figure 8:
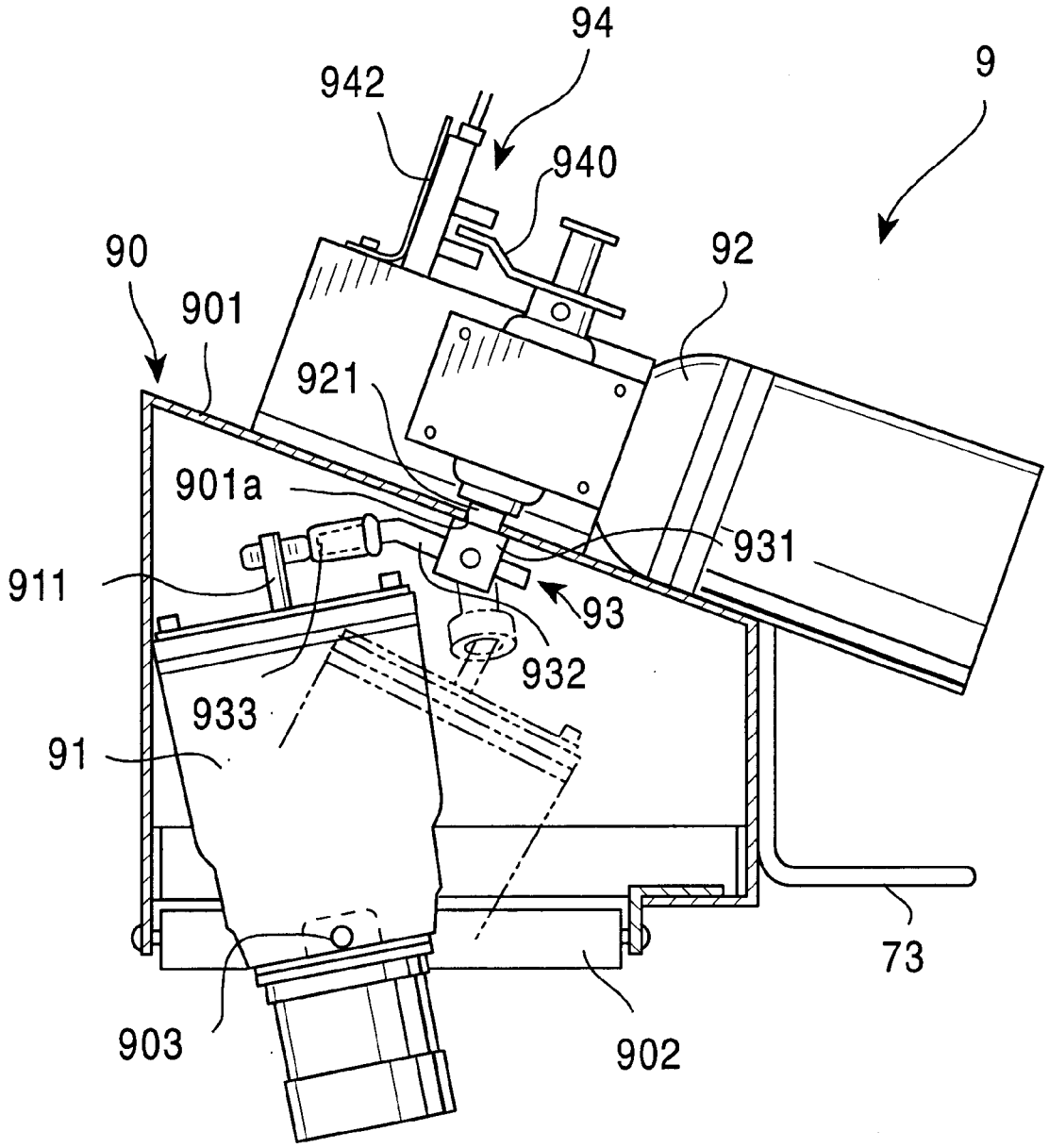
FIG. 8 is an illustration of the construction of a swivel mechanism for causing swivelling motion of a light projecting unit.
Figure 9:
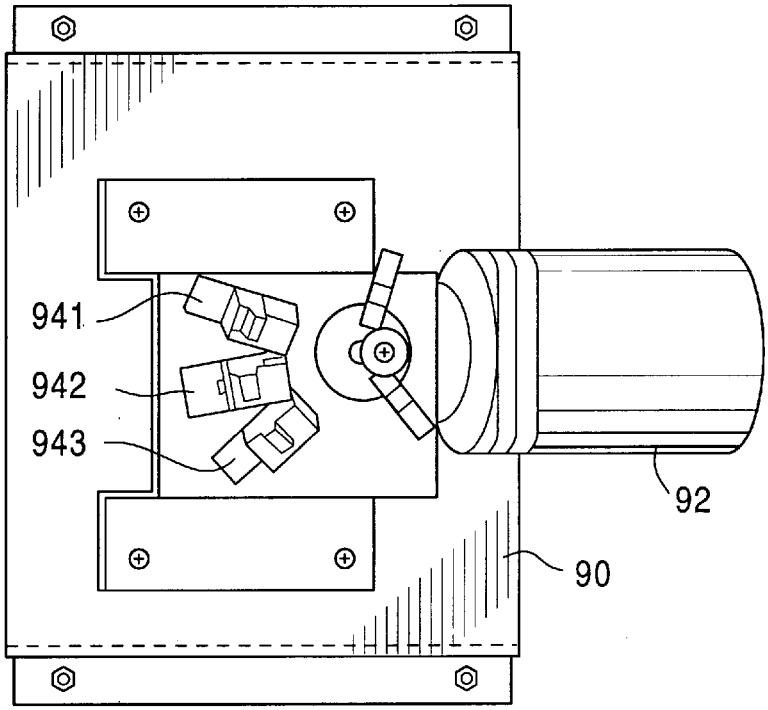
FIG. 9 is an illustration of the light projecting unit as viewed from the upper side thereof.

FIGS. 8 and 9 show the detail of the swivel mechanism. As will be seen from these Figures, the swivel mechanism has a bracket 90 which is fixed to a member 73 which in turn is fixed to the crown 7. The swivel mechanism further has a swivel light projector 91, a swivel motor 92 for causing swiveling motion of the light projector 91, a swivel mechanism 93 for converting the rotation of the shaft of the swivel motor 92 into the swivelling motion of the light projector 91, and a swivel angle sensor 94. The bracket 90 has a boxlike structure formed of a top plate and four side plates, with the bottom opened downward. The top plate 901 of the bracket 90 is slanted so as to descend towards the right end as viewed in FIG. 8. A frame member 902, having a rectangular frame of a size slightly smaller than the bottom opening of the bracket 90, is swingably secured to the left and right side plates of the bracket 90 at a position midst between the front and rear side plates, i.e., at the center of the bracket 90 in the direction normal to the sheet of the drawing of FIG. 8, for a swinging motion.

The light projector 91 has a cylindrical casing which is closed at its upper end and which accommodates a light source (not shown) and a lens (not shown) disposed at the opposite side of the light source to the closed upper end of the casing. The lens serves to determine the diameter of the light beam and the optical axis of the same. The light source may be of the type which emits light of a specific color, or may be a white light source which emits white light, e.g., a halogen lamp, with a color filter disposed on the light emitting side of the light source. Thus, the light projector 91 can project a light beam of a desired color. Horizontal trunnion shafts 903, which are perpendicular to the optical axis of the light projector 91, are provided on the cylindrical casing at positions which diametrically oppose each other and which are axially central or rather close to the open lower end of the cylindrical casing. These trunnion shafts are rotatably supported by the front and rear side plates of the bracket 902 at positions substantially midst between the left and right side plates of the same. Consequently, the light projector 91 is supported by a gimbal structure which is constituted by the frame 902 and the trunnion shafts 903 arranged to permit the projector 91 to swing in two orthogonal planes, whereby the optical axis of the light projector 91 can scribe a circle.

The arrangement is such that the direction of projection of the light by the light projector 91 is changed as a result of a tilting motion of a swivel rod 911 provided on the closed upper end of the light projector 91.

The aforesaid swivel motor 92 is mounted on the slant top plate 901 of the bracket 90. A rotary shaft 921 extends through an aperture 901*a* formed in the slant top plate 901. The swivel mechanism 93 further has a holder 931 attached to the lower end of the rotary shaft 921. An arm 932 having a predetermined length is secured to the holder 931 so as to extend in the direction perpendicular to the rotary shaft 921. A flexible connecting member 933 has a fitting portion fitting on the end of the arm 932 and a ring portion connected to the fitting portion. Thus, the flexible connecting member is connected to the end of the arm 932. The flexible connecting member 932 therefore rotates about the axis of the rotary shaft 921 in accordance with the rotation of the rotary shaft 921. The ring portion of the connecting member 933 receives the aforementioned swivel rod 911 of the light projector 91, so that the swivel rod 911 rotates together with the connecting member 933. The joint between the ring portion of the connecting member 933 and the swivel rod 911 of the light projector 91 may be accomplished in a manner like a universal joint. Thus, the swivel mechanism has the rotary shaft 921 which is arranged perpendicularly to the slant top plate 901 of the bracket 90 and which forms a predetermined angle with respect to the optical axis of the light projector 91, so that the spotlight SL moves along an arcuate path accurately following the curvature of the annular white flat surface 20.

A radially extending tab 940 is secured to an upper portion of the rotary shaft 921. Three photo-interrupters 941, 942 and 943 are arranged at an equal distance from the axis of the rotary shaft 921, along the path of rotation of the tab 940. Each photo-interrupter has two portions which oppose each other across the path of rotation of the tab 940. A rear photo-interrupter 941 corresponds to the posture of the light projector 91 at which the spotlight SL impinges upon a 90° behind position on the annular white flat surface 20, while a front photo-interrupter 943 corresponds to the posture of the light projector 91 at which the spotlight SL impinges upon a 90° advanced position on the white flat surface 20. The central photo-interrupter 942 corresponds to the posture of the light projector 91 at which the spotlight impinges upon a position which is almost right below the light projector 91. Means are provided for detecting the swivelling of the light projector 91 beyond the marginal 90° positions behind and ahead of the central position, so as to effectively prevent breakdown of the mechanism which may otherwise occur due to excessive stroking of the light projector 91 when the front and rear photo-interrupters erroneously fail to detect the tab. Although the left light projecting unit 9 alone has been described, it is to be understood that another light projecting unit 9, having the same construction, is provided also under the right side of the crown 7.

A description will now be given of the pattern of projection of light beams, with specific reference to FIGS. 10A to 10C. In this Figure, a circle marked by "R" indicates the position of the light spot formed by the spotlight SL from the right light projector 91, while a circle marked by "L" indicates the light spot formed by the spotlight SL from the left light projector 91. Thus, semi-circular arrows represent the annular white flat surface 20 of the base portion 2 along which the light spots oscillate.

Figure 10A:
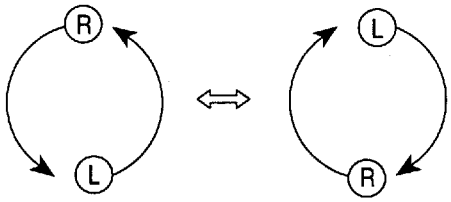
FIGS. 10A, 10B and 10C are illustrations of different patterns of projection of light beams.
Figure 10B:
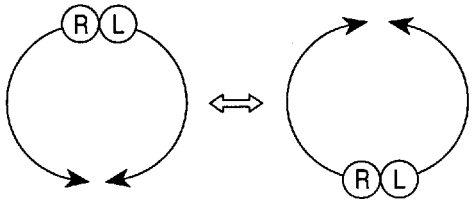
Figure 10C:
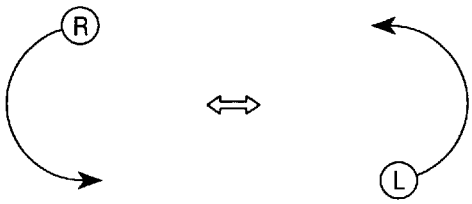

FIG. 10A shows a pattern in which the spotlights SL from the left and right light projectors 91 move synchronously in the same direction with a 180° positional or phase difference and then move back in the same counter direction with 180° difference. This operation is performed repeatedly. In FIG. 10B, cycles are repeated in which the light spots of the spotlights SL of the left and right light projectors 91 are initially set at the same position and move in opposite directions through 180°, respectively, and then move back to the starting position. In FIG. 10C, the light spot formed by the spotlight SL of the right light projector 91 is made to move through 180° while the left light projector is kept off. Then, the right light projector 91 is turned off and the left light projector 91 is turned on, so that the light spot of the spotlight SL from the left light projector 91 alone moves through 180° in the same direction. Thus, the left light projector 91 is returned without forming light spot to the starting position while the spot light of the right light projector moves along its path and, similarly, the right light projector 91 is returned without forming light spot to the starting position while the light spot formed by the left light projector travels along its arcuate path. This operation is cyclically repeated.

Figure 11A:
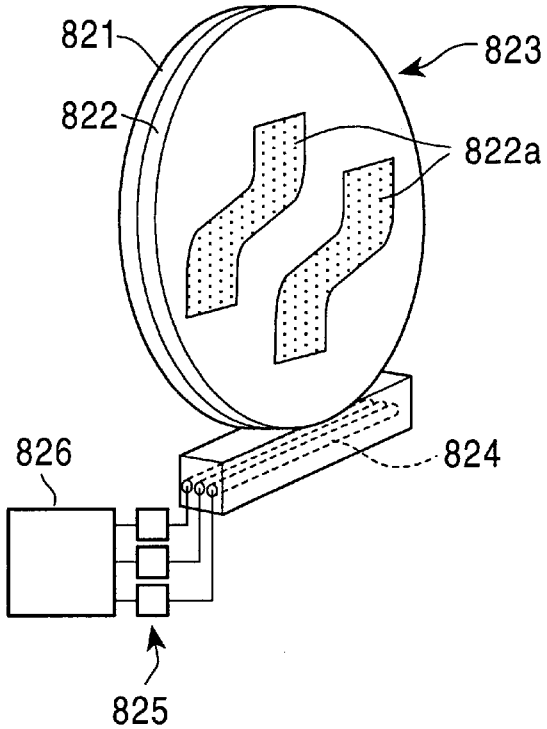
FIG. 11A is a perspective view of an illuminating structure of an illuminating portion of a support.

A description will now be given of the construction of the illuminating unit 82 on the support portion 8, with reference to FIGS. 11A, 11B and 11C. FIG. 11A is a perspective view of the illuminating unit 82, FIG. 11B is a sectional view of a luminescent plate and FIG. 11C is a plan view of a different construction of the illuminating unit.

Figure 11B:
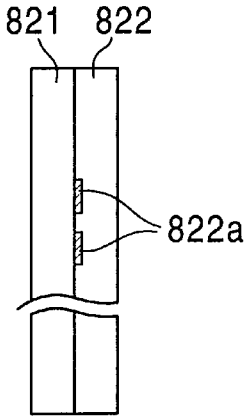
FIG. 11B is a sectional view of a luminescent plate.
Figure 11C:
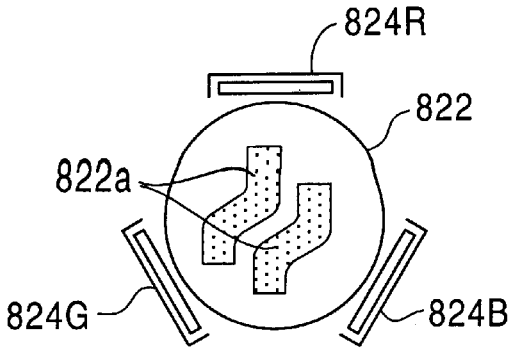
FIG. 11C is an illustration of a modification of the illuminating portion.

Referring first to FIGS. 11A and 11B, the illuminating unit 82 has a peripheral annular cover 820, a luminescent plate 823 disposed inside the cover 820 and composed of a pair of transparent plates 821, 822, a light source unit 824 which is disposed at a suitable position along the luminescent plate 823, a driver 825 and a light source control unit 826. The transparent plate 821 of the luminescent plate 823 is made of a glass sheet or a sheet of an acrylic resin, while the transparent plate 822 is made of a resin which may be an acrylic resin. The inner surface of the transparent plate 822 facing the plate 821 is engraved in a predetermined configuration as at 822*a* so as to provide a light diffusion surface. In the illustrated embodiment, the luminescent plate 823 has a diameter on the order of several tens of centimeters and a thickness of 10 mm or so. A reflective film, presented by a reflective tape or a reflective material, is formed on the peripheral surface of the luminescent plate 823 except a light guide portion which faces the light source unit 824. Light introduced into the luminescent plate 823 from the light source unit 824 through the light guide portion is reflected by the peripheral reflective film and is scattered so that the luminescent plate 823 illuminates at a predetermined level of luminance.

The light source unit 824 includes three fluorescent lamps 824R, 824G and 824B of red (R), green (G) and blue (B) colors which are arranged in parallel with one another within a box-like casing which faces and opens towards the peripheral surface of the luminescent plate 823. The fluorescent lamps 824R, 824G and 824B may be of the type which emits the light of the respective colors or all these may be white luminescent lamps which are coated by the filters of R, G and B colors so that light of each color is obtained through each filter.

The driver 825 has color drivers 825R, 825G and 825B which correspond to the respective fluorescent lamps 824R, 824G and 824B so as to supply electrical power to the corresponding fluorescent lamps so that the lamps can illuminate independently of one another. The light source control unit 826 supplies illuminating signals to each, two or all of the three color drivers 825R, 825G and 825B so that the fluorescent lamps 824R, 824G and 824B illuminate independently or in a suitable combination to provide a monochromatic or composite color light, thus contributing to further enhancement of the stage effect on the play.

The pattern of supply of the illuminating signals may be suitably determined so as to provide different stage effects according to the state of the game machine or the phase of the play. For example, different patterns of supply of the illuminating signals are used when the game machine is in a demonstrating mode to tempt the players, when the game is started and when a ball B has been detected by the reading portion 5, and when the player has won a high score by satisfaction of a predetermined condition which is expressed in terms of combinations of the magnetic codes read from the extracted balls B.

The light from the light source unit 824 propagates through the luminescent plate 823 and is reflected in a random manner by the diffusion surface presented by the engraved portion 822*a*, so as to be diffused in all radial directions. Consequently, the engraved portion 822*a* is recognized as if it emits light by itself. In this embodiment, it is possible to produce light of any desired color, due to the use of the lights of three primary colors, thus enhancing the stage effect on the play. The luminance of each fluorescent lamp 824R, 824G and 824B can be controlled through a direct luminance control or by controlling the duty ratio of illumination, whereby illuminating light of any composite color can be obtained.

FIG. 11C shows an alternative arrangement in which the fluorescent lamps 824R, 824G and 824B are arranged at equi-spaced three positions around the luminescent plate 823. Such an equi-spacing of the light sources of different colors ensures more uniform distribution of light throughout the engraved portion 822*a*. In this case, the peripheral surface of the luminescent plate 823 is devoid of the reflective film at the portions confronted by the respective fluorescent lamps 824R, 824G and 824B.

Figure 12A:
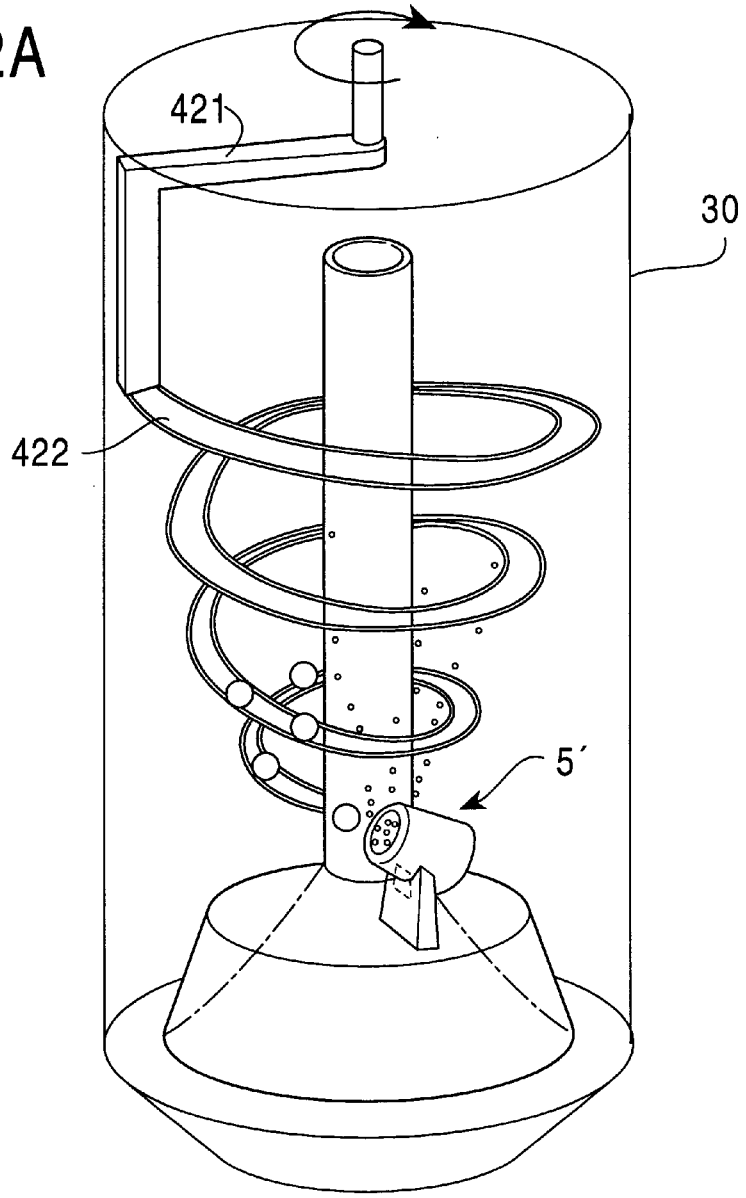
FIG. 12A is a schematic perspective view of a modification of the reading portion.
Figure 12B:
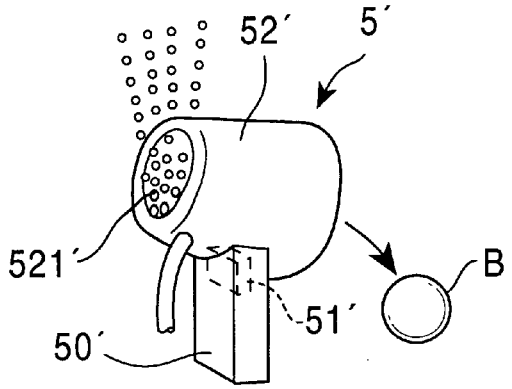
FIG. 12B is an enlarged perspective view of the reading portion shown in FIG. 12A.

FIG. 12A is a schematic perspective view of a modification of the reading portion 5, while FIG. 12B is an enlarged perspective view of the same. The reading portion, denoted by 5', has a supporting portion 50', a sensor element 51' embedded in the supporting portion 50', and a tubular portion 52' supported by the supporting portion 50' and having a bore of a diameter slightly greater than that of the ball B, the tubular portion 52' being slightly inclined. The tubular portion 52' has a ball inlet 521' which is disposed to face the rotation path of the lower end of the guide rail 422, so that a ball B released from the lower end of the guide rail 422 is thrown into the ball inlet 521' provided that at this instance the lower end of the guide rail 422 faces the ball inlet 521'. The magnetic codes of the ball B are read by the sensor element 51' while the ball B passes through the tubular portion 52', whereby the ball B is "extracted". In this modification, when a ball B is received in the tubular portion 52', bubbles of air are generated from a lower portion of the ball inlet 521' so as to prevent any succeeding ball B, which has rolled down along the guide rail 422 immediately after the received ball B, from entering the tubular portion 52'. In order to enable generation of air bubbles, a conduit is led to the lower portion of the tubular portion 52', defining the ball inlet 521', from the compressor via a hose or the like, and tiny holes are provided in the lower portion of the ball inlet 521', so that compressed air is relieved from the tiny holes to form bubbles as illustrated n FIG. 12B. The air bubbles serves as a barrier which prevent any subsequent ball B from coming into the tubular portion 52' immediately after the entry of the preceding ball B. The supply of the air for generating the air bubbles is continued, at the shortest, to a moment immediately before completion of one full rotation of the guide rail 422 after the receipt of the ball B in the tubular portion 52'. Continuation of bubble generation also serves to minimize the risk that any ball B other than those rolling down along the guide rail 422 is accidentally received in the reading portion 5'.

Figure 13:
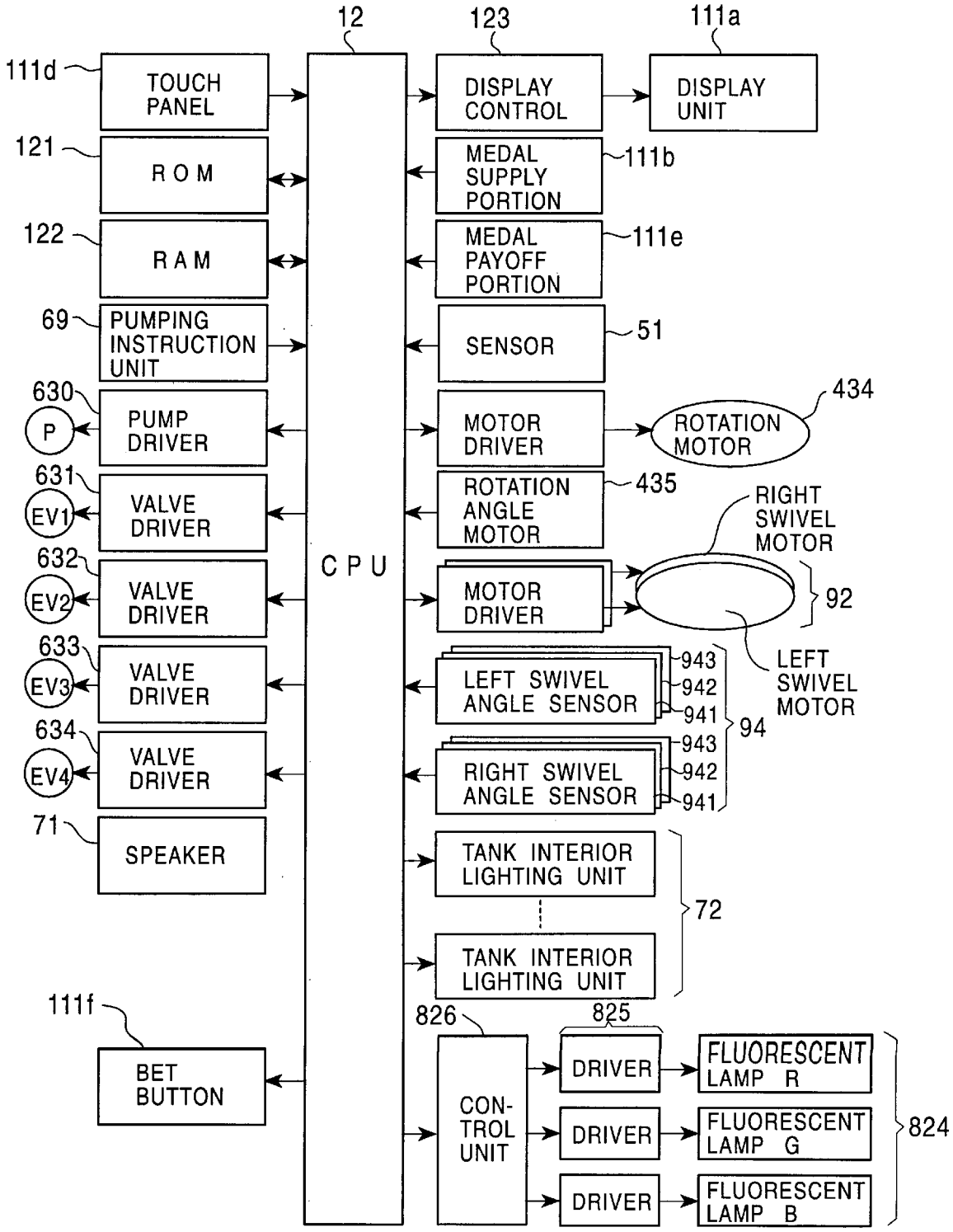
FIG. 13 is a diagram showing control blocks of the game machine embodying the present invention.

A description will now be given of control blocks of the game machine embodying the present invention, with reference to FIG. 13.

Referring to this Figure, a central processing unit (referred to as "CPU", hereinafter) 12 performs overall control of the whole game machine. The CPU 12 has a ROM 121 storing control programs and a RAM 122 which temporarily stores data under processing. In this embodiment, four kinds of games are available, and the game programs of all these games are stored in the ROM 121. The RAM 122 not only stores temporal game data but also statistic data in regard to the extraction of the balls B in previous plays so that such data is displayed in the form of, for example, a table so that the player can bet while making reference to the statistic data.

Although the CPU conducts overall control of the whole machine, the arrangement may be such that a microcomputer commanding the mechanical part of the machine performs the control of the mechanical section 1 and the CPU 12 communicates with such a microcomputer to indirectly control the mechanical section 1. The CPU 12 performs various functions in accordance with the kinds of games. These functions will be described later in relation to the description of respective games.

The medal a supply portion 111*b* detects supply of medals as well as the number of the medals supplied. The CPU determines, based on information given by the medal supply portion 111*b*, whether or not the number of the supplied medals has reached a predetermined number which is necessary for starting a game and permits the game to start when the predetermined number has been reached. The medal payoff portion 111*e* pays off a predetermined number of medals corresponding to the score gained by the player. A credit play mode is available in which the number of the medals deposited to the player is monitored by the RAM 122 and the balance is paid off at once when requested by the player. A pumping instruction unit 69 has a switch or the like which, when turned on for the purpose of maintenance, causes the CPU 12 to give a draining signal to the pump driving unit 630 and solenoid valve driving signals to the valve drivers 631 to 633, so that the pump P is started and the solenoid valves EV1 to EV4 are suitably controlled to allow the water W inside the tank to be drained to the sub-tank 64. After the maintenance work, the switch is operated to give tank filling instruction so that the water W is returned from the sub-tank 64 to the tank 30.

During the playing, various kinds of information are displayed on the display portion 111*a* of each terminal 111 in the input section 11, as will be described below with reference to FIGS. 14 to 18.

Figure 14:
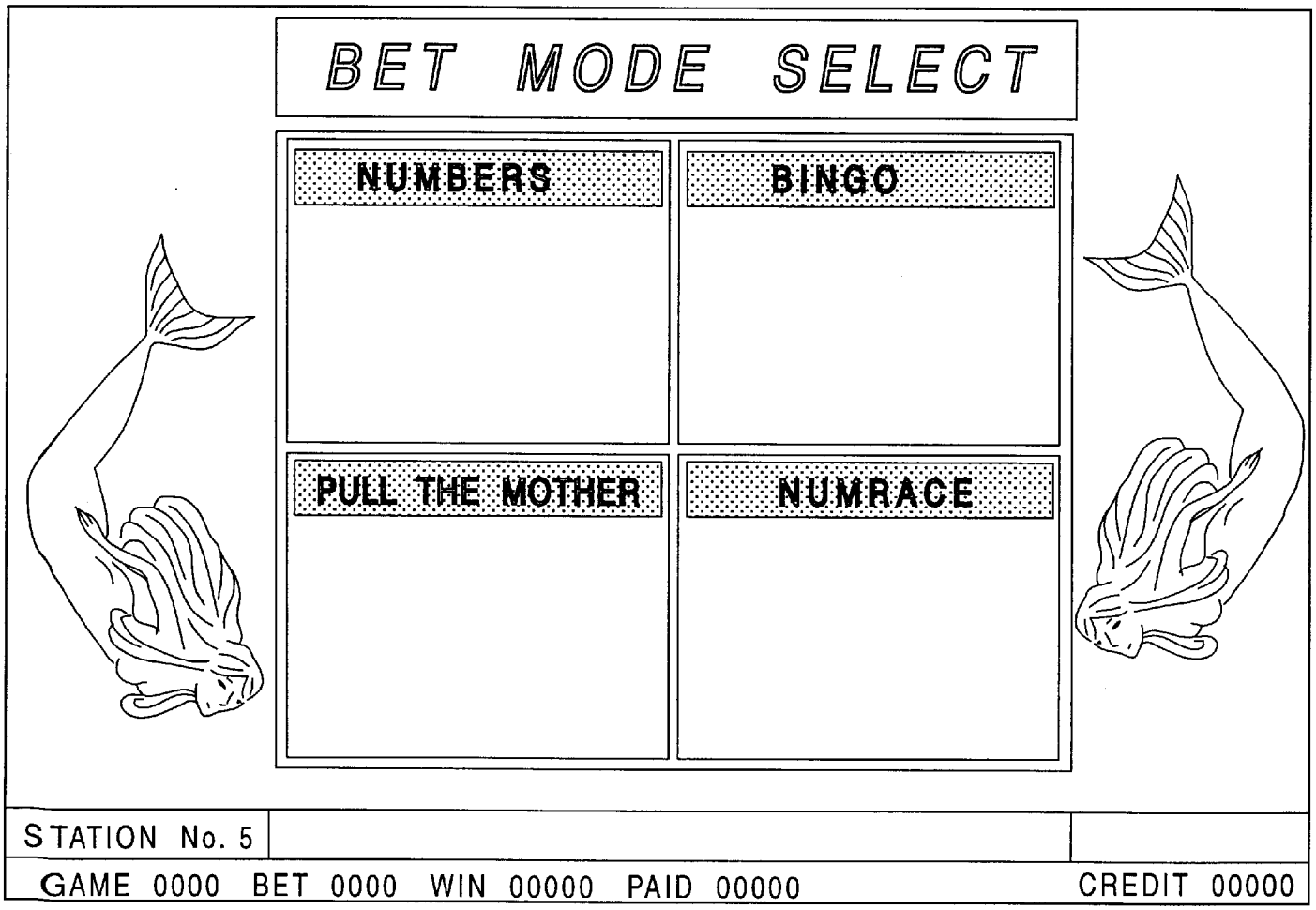
FIG. 14 is an illustration of an initial screen of a display of the game machine.

FIG. 14 illustrates an initial screen which shows types of games available in this game machine. In the illustrated embodiment, there are four types of games: namely, NUMBERS GAME, BINGO GAME, PULL THE MOTHER GAME and NUMRACE GAME. The player can select one of these games by touching, with a finger, a frame showing the name of the game of interest. The coordinate position of the touch is read by the touch panel 111*d*, and the game program is read from the table of the selected game which has been stored in the ROM 121 in relation to the coordinate position. Then, the content of the display is changed to that of the selected game. The frames such as STATION. No., GAME, BET, WIN, PAID and CREDIT, shown at a lower portion of the initial screen, are common to all types of the games available on the machine. The frame GAME shows the total number of the plays of the game, BET shows the number of the medals bet, WIN shows odds, PAID shows the number of the medals paid off, and CREDIT shows the number of the medals deposited.

The game proceeds in accordance with the operation of the game machine having the construction as described with reference to FIGS. 1 to 12 under the control of the blocks described in connection with FIG. 13. In each game, five balls B are extracted from the 30 balls B, in accordance with the order in which the balls B are trapped in the reading portion, and magnetic codes of these balls B, indicative of the color and the numeral carried by each ball B, are read by the reading portion 5, whereby the numerals and colors are picked up. Each of the four games relies upon these colors and numerals.

Figure 15:
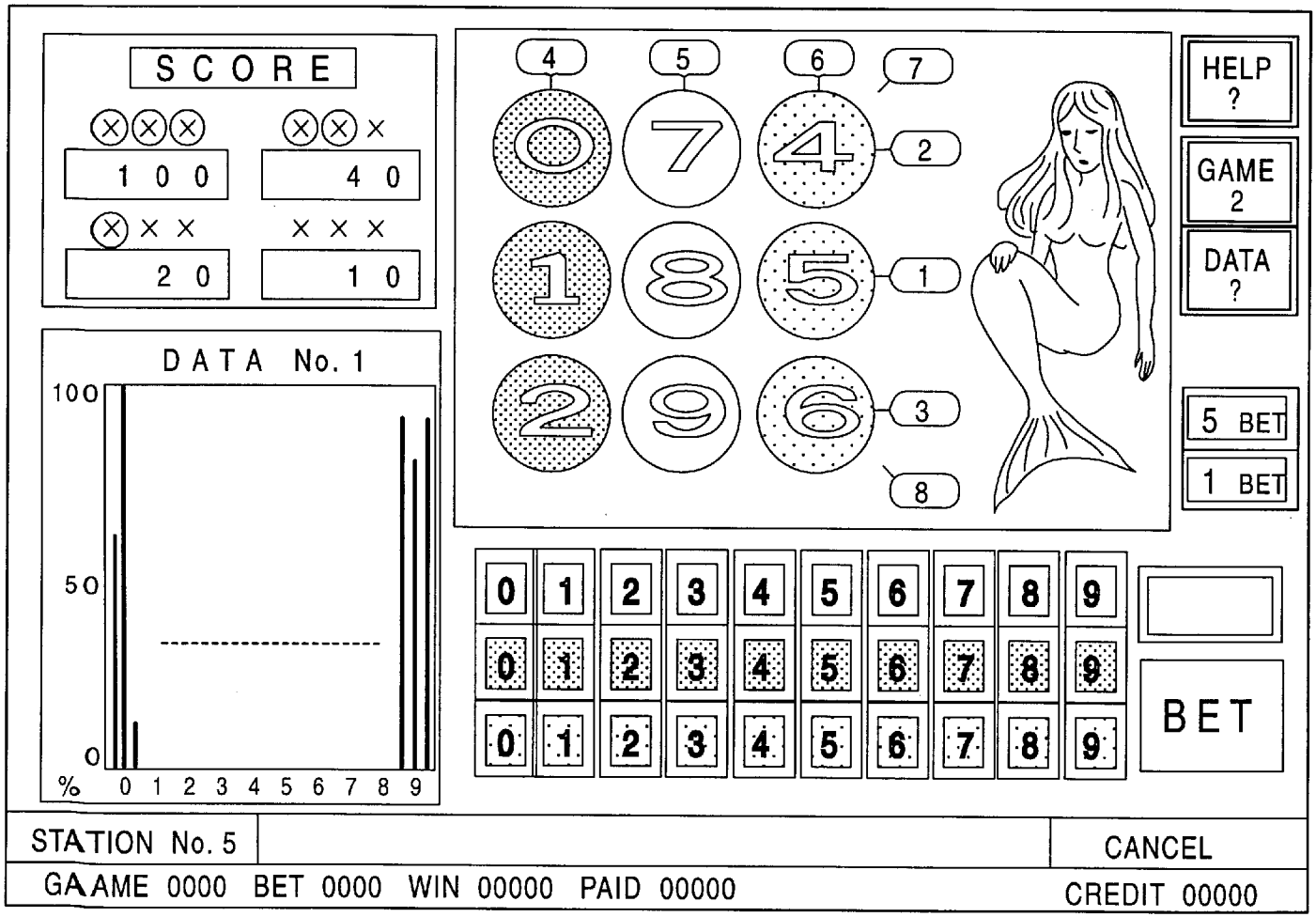
FIG. 15 is an illustration of the content displayed when a NUMBERS GAME mode has been selected.

The operation performed when the NUMBERS GAME has been selected will be described with reference to FIG. 15. There are three horizontal lines of numerals each containing numerals 0 to 9, at a right portion of the screen above the aforesaid common frames. The first non-halftone line corresponds to red color. The second line, which is shown by thick halftone, corresponds to blue color, while the third line, shown by thin halftone, corresponds to yellow color.

In the NUMBERS GAME, the CPU 12 performs the following functions: a matrix display function for causing the display control unit 123 to display a matrix on the screen of the display portion 111*a*; an input display function by which the ball type and positions on a predetermined line of the matrix, specifically, the left, center and right (first, second and third columns) of the second line of the matrix, are appointed by the player so that imaginary balls or ball marks together with the sign of the ball type are displayed on these positions of the matrix; an automatic display function for displaying, in the remainder lines (first and third lines) of the matrix, ball marks which have relevancy to the ball types appointed by the input display function, together with the signs indicative of the ball types; a first determining function for determining whether or not the type of the extracted ball coincide with that of any of the ball marks displayed, or whether or not only the numeral, which is one of the attributes of the ball type, of the extracted ball coincides with that of any of the ball marks displayed; a display mode changing function for changing the mode of display only for the ball marks with which the coincidence has been obtained in terms of the ball type or numeral; a second determining function which determines whether or not the ball marks displayed in the changed display mode form any one of lines including the lines, columns and diagonal oblique lines of the matrix; and scoring function which produces instructions for paying the medals of a number corresponding to odds, when any one line is completed with the ball marks displayed in the changed display mode.

A matrix of circular boxes arranged in 3 lines and 3 columns is displayed immediately above the abovementioned three lines of numerals. The player can arbitrarily set the colors and numerals in the circular boxes of the second line of the matrix. In this case, the player has set numeral 1 of red color (this will be expressed as "red #1"), numeral 8 of blue color (blue #8) and numeral 5 of yellow color (yellow #5), as illustrated. Then, the machine automatically sets colors and numerals in the circular boxes of the first line, such that the sequence of the colors is the same as that of the second line but the numerals of each circular box is smaller by one than that in the corresponding box of the second line of the matrix. At the same time, colors and numerals are set in the third line of the matrix such that the sequence of the colors is the same as that of the second line but the numerals of each circular box is greater by one than that in the corresponding box of the second line of the matrix. When a numeral in the matrix coincides with the numeral carried by an extracted ball B, the display of the numeral is highlighted, flickered or otherwise changed to indicate the fact of the incidence. Numerals "4", "5" and "6" are shown at right above the first line of the matrix at positions corresponding to the three columns. Similarly, numerals "7", "2", "1", "3" and "8" are displayed on the right side of the third column of the matrix at positions corresponding to the three lines, although numerals "7" and "8", which represent diagonal oblique lines, are respectively shown above and below the first and third lines of the matrix. These numerals "1" to "8" correspond to eight types of combinations of colors and numerals, including three presented by the three lines, three presented by the three columns, and two presented by two diagonal lines of the matrix. When the extracted five balls B contain any three balls B the numerals of which make a numeral series coinciding with one of the eight numeral series stated above, such a coincidence is judged as being a "hit".

An area on the left upper corner of the screen shows the score which is given to the hit, depending on the degree of coincidence of the colors between the balls and the "hit" numeral series. When there is no coincidence of color in the "hit" numeral series, the odds are only 10, so that the player gets medals of the number which is 10 times that of the bet. When coincidence is obtained on one numeral in the "hit" numeral series, 20 is given as the odds. When coincidence has been attained on two numerals out of the three, odds are 40 and, when coincidence of color has been obtained on all the three numerals of the numeral series, the player is paid a number which is 100 times that of the bet.

An area preserved in the left lower corner of the screen shows, in the form of bar graphs, the statistic data concerning the colors of balls of each numeral of the balls extracted in the preceding plays. Thus, in the illustrated case, the blue #0 ball was extracted in each of the plays.

In this game, the arrangement may be such that the numerals on the first line and the third line of the matrix appear progressively so that the number of the numeral lines to be hit is increased in accordance with the increase in the bet, i.e., the number of the medals bet. For instance, numerals appear in the first line in response to a predetermined increment of the bet, and numerals appear in the third line in response to a further predetermined increment of the bet. In FIG. 15, all the nine circular boxes have been filled by numerals. Areas 1 BET and 5 BET appearing on the right end of the screen indicates the number of the medals bet. For instance, a single touch on the 5 BET indicates that the player has bet 5 medals.

Figure 16:
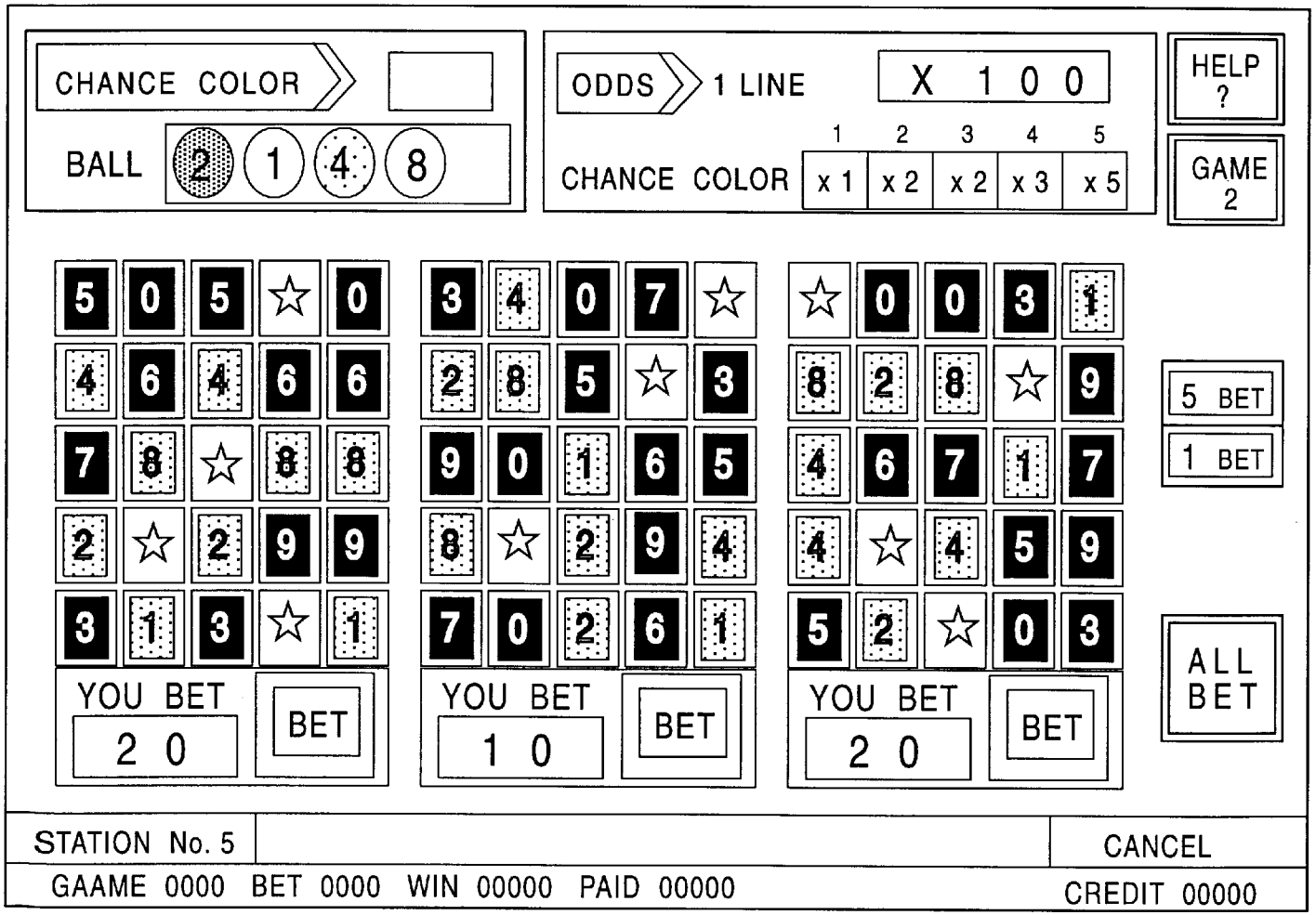
FIG. 16 is an illustration of the content displayed when a BINGO GAME mode has been selected.

A description will now be given of the operation performed when the BINGO GAME has been selected. FIG. 16 illustrates the content displayed on the screen when this mode of game has been selected. Three bingo cards are displayed on the screen. The arrangement may be such that the player can arbitrarily select three bingo cards from among numerous bingo cards which have been formed and registered in the ROM 121. Alternatively, the player may form bingo cards in accordance with a predetermined rule. The rule may be such that the card should have four boxes to which star marks indicative of any color and numeral are attached, while colors and numerals are arranged in a random manner. For instance, colors are suitably allocated to predetermined numbers of boxes among the remainder 21 boxes, with each of the numerals 0 to 9 appearing in boxes of a number which is at least one but does not exceeds a predetermined limit.

In FIG. 16, the numerals on each bingo card are shown in solid black boxes. Halftone boxes indicate that the numerals in these boxes coincide with those of extracted balls B. Actually, each of the boxes is painted with one of red, blue and yellow colors.

In the BINGO GAME, the CPU 12 implements the following functions: a bingo card displaying function which displays on the screen one or more bingo cards each having "n" boxes arranged in the form of a matrix (5 lines and 5 columns in the illustrated embodiment) by allocating numerals to, for example, 21 or 22 boxes and a star mark to all the remainder 4 or 3 boxes; a first determining function for determining whether the numeral attribute of the ball type of the extracted ball coincides with any of the numerals in the displayed matrix; a display mode changing means for changing the mode of display of the box or boxes having the numeral coincident to the numeral of the extracted ball; a second determining function for determining whether or not there is any line, column or diagonal oblique line of the matrix in which all the boxes are displayed in the changed display mode; and a scoring function which, when there is a line in which all the numerals except for the star mark are displayed in the changed display mode, entitles the player to a "win" and gives a score for payment of medals.

The player can bet medals by first touching the BET button 111*f*, and then touching 1 BET or 5 BET appearing on the right end of the screen. The number of the medals thus bet are shown under the bingo cards. In the illustrated case, the numbers of bets are 20, 10 and 20 for the left, central and right bingo cards. The game is commenced after completing the bet on any desired or all of the three bingo cards. The menu ALL BET is used when the player bets in a credit mode. The player can bet all the medals deposited in the game machine on the designated card by touching this menu. Coincidence of numeral series between the numerals of the extracted balls B and one of 12 lines of numerals set on the bingo card, including 5 horizontal lines, 5 vertical lines and 2 oblique lines, is a "hit".

In the illustrated case, four balls have already been extracted. These balls are blue #2 ball, red #1 ball, yellow #4 ball and the red #8 ball. Therefore, in each bingo card, the display of the boxes carrying one of the numerals 1, 2, 4 and 8 are highlighted, flickered or otherwise changed to inform the player of the fact of coincidence. The odds are shown at a right upper position on the screen. In this case, odds of 100 are given for each of line which has completed a bingo. A lucky color, which is one of red, blue and yellow, is set in each play terminal for each game. The lucky color is shown beneath the display of the odds as the CHANCE COLOR. Odds are multiplied with factors which are determined in accordance with the number of the extracted balls which are coincident not only in numerals but also in color. Such multiplication factors are shown immediately below the indication of the odds on the screen. For instance, when coincidence has been attained between the extracted five balls and one or more of the 12 lines set on each bingo card not only in the numerals but also in colors, the odds which have been set to 100 are multiplied with 5, i.e., the odds are increased. In the game machine of the present invention, there is a possibility that an identical ball is extracted repeatedly because the ball once extracted is shuffled again with other balls. In this game machine, therefore, the control may be executed such that, when an identical ball, i.e., the ball of the same color and numeral, has been extracted again, the coincidence which has been attained by the previous extraction of the same ball is canceled, so that the fun of the game is further enhanced. In the illustrated embodiment, numerals 1. 2 4 and 8 have been extracted, so that the third line "7, 8, 8, 8" of the left bingo card is in a condition ready for completing bingo. In regard to the central bingo card, the second column "4, 8, 0, 0", the fourth line "8, 2, 9, 4" and the diagonal line "1, 7" from right upper corner to left lower corner of the bingo card are waiting for bingo. In the right bingo card, the first column "8, 4, 4, 6" is in a condition ready for bingo.

Figure 17:
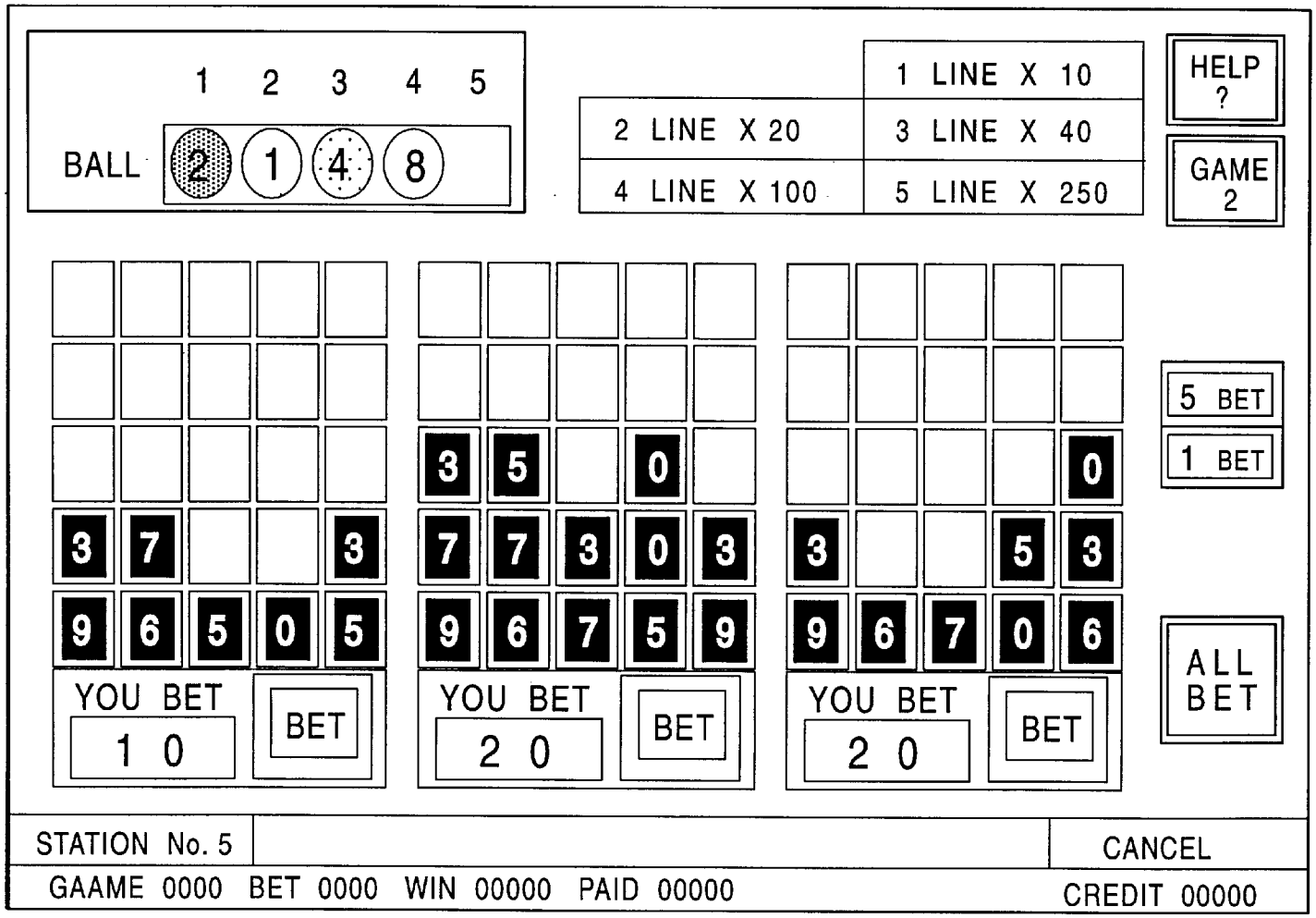
FIG. 17 is an illustration of the content displayed when a PULL THE MOTHER GAME mode has been selected.

A description will now be given of the operation performed when the PULL THE MOTHER GAME has been selected, with reference to FIG. 17 which shows the content displayed on the screen in this mode of game. Three cards, each having 25 boxes, are shown on the screen. At the beginning, all the boxes are filled with numerals in a random manner and a predetermined color is given to all these boxes. Alternatively, different colors may be allocated to these boxes in a random manner to enhance the fun of the game. The cards may be prepared in the same way as that in the BINGO GAME. The cards, however, do not have any star mark which is used in the bingo cards.

In the PULL THE MOTHER GAME, the CPU 12 implements the following function: a displaying function for displaying a plurality of boxes which are arranged in the form of a matrix composed of a plurality of lines and columns, the columns being perpendicular to lines and each containing a plurality of boxes, e.g., 5 boxes, while allocating in a random manner a plurality of ball type attributes, e.g., only numerals, to these boxes; a first determining function for determining whether there is any coincident box having the ball type attribute coincident to the numeral read from an extracted ball; a drop displaying function which, when there is any coincident box in any column, changes the display content in such a manner that, in each of the columns having the coincident box, the stack of numerals in the boxes stacked on the coincident box move downward by an amount corresponding to the number of the coincident boxes, while white blank boxes of a number corresponding to the coincident boxes appear on the stack of the numerals; a second determining function which determines whether or not there is a column in which all the five boxes have been changed into the white blank boxes; and a scoring function which regards any column in which all the boxes have been turned to white blank as being a "win" and determines the score for payment of the medals.

In the operation of the game machine in this game mode, as a ball B is extracted, the boxes having the numeral of the extracted ball B are changed into white blanks, and the stack of numerals which has been placed on each box which has just been changed into white blank drops to fill the white blank box now formed. When the boxes on the left and right sides of the box into which a numeral has been dropped have the same numeral as the dropped numeral, these two blocks having such a numeral are also changed into white blanks. The user "wins" on each card when all the boxes in at least one column (vertical line) have been changed into the white blanks. Odds are set in accordance with the number of the wins, i.e., the number of the columns in which all the five boxes have been changed into white blanks. In the illustrated embodiment, odds are set to be 10 for one win (one column or vertical line), 20 for two wins, 40 for three wins, 100 for four wins, and 250 for five wins, i.e., when boxes have been changed into white blanks in all five columns (vertical lines). In FIG. 17, numerals 2, 1, 4 and 8 have been deleted from the boxes of all the three cards, because balls of the numerals 2, 1, 4 and 8 have already been extracted.

Figure 18:
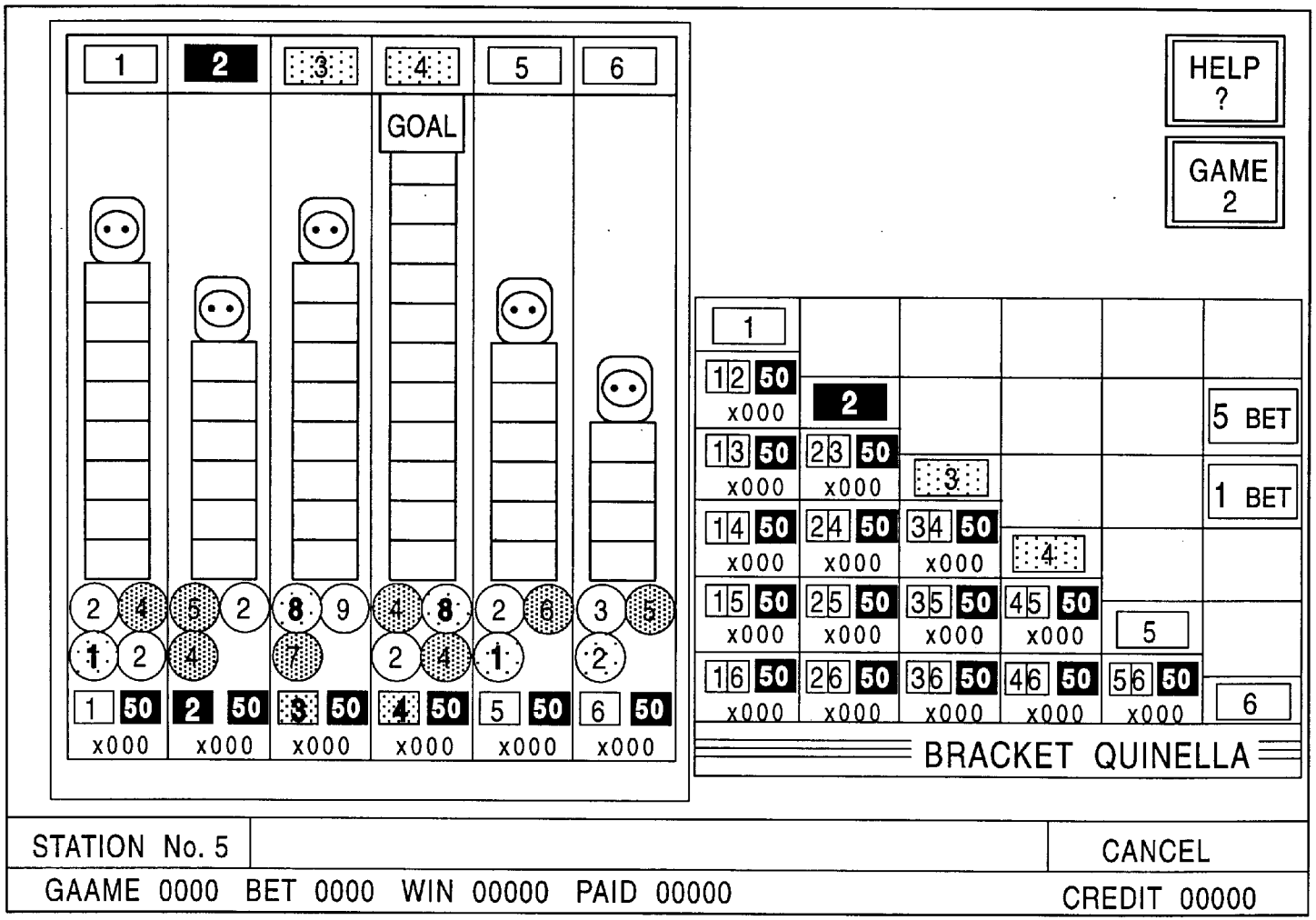
FIG. 18 is an illustration of the content displayed when a NUMRACE GAME mode has been selected.

A description will now be given of the operation performed when the NUMRACE GAME has been selected with reference to FIG. 18 which shows the content displayed on the screen when this mode is selected. There are six columns displayed on a left portion of the screen. Odds in accordance with a win system (a system in which only the winner of the first place is forecast) are shown below the respective columns. Ball marks showing imaginary balls each having its own color and numeral are set for each of the six columns and are shown by illustration immediately above the indication of the odds. The number of the ball marks set for each column may be freely selected between 1 and 4. In the illustrated case, each column has three or four ball marks set therein. Basically, as a matter of common sense, smaller odds are set for columns having greater number of imaginary balls. The numbers, as well as the colors and numerals, of the ball marks may be set in a random manner for each column. The right half part of the screen displays an odds table in accordance with place-show system (a system in which winners of the first and second places are forecast). The player can select either one or both of the "win" system and the "place-show" system, and may bet on the selected system or systems by touching the menus of 1 BET or 5 BET.

In the NUMRACE game, the CPU 12 implements the following functions: a mark displaying function for displaying, on the screen, a plurality of columns (6 columns in the illustrated embodiment) each having a predetermined number of boxes each of which is to be filled with a predetermined mark, e.g., a rectangle; peculiar information displaying function for displaying for each of the columns a suitable number (from 1 to m, m being 4 in the illustrated embodiment) of ball marks which have been selected in a random manner and which have peculiar information indicative of the ball types; a first-place inputting function by which a player appoints one of the columns which the player forecasts to win the first place; a first determining function which determines whether or not there is any column having a ball mark of the type coincident to the type of an extracted ball; a stepwise displaying function for filling, on the display, the predetermined mark in one box of the column having a coincident ball mark, starting from the lowermost box of the column; a first-place detecting function for detecting the column in which the number of the displayed predetermined marks has reached a predetermined number, e.g., 11, prior to other columns; a second determining function which determines whether or not the column detected by the first-place detecting function coincides with the column which the player has forecast and appointed as being the first-place winner by the first-place inputting function; and a scoring function which calculates the score for paying of medals based on the result of determination by the second determining means.

In this game, each time a ball B is extracted, the numeral and color of the ball are checked up with the colors and numerals of the imaginary balls set for each column. When either the numeral or the color is found among the balls set in the column, a stack of white boxes, i.e., rectangles as the above-mentioned predetermined mark, grows upward by an amount corresponding to one white box, whereas, when a ball of the same color and numeral as those of the extracted ball has been set for a column, the stack of the white boxes grows in that column by an amount corresponding to two white boxes. The six columns thus run a race. When the number of the white boxes of the stack reaches 11, the stack reaches a GOAL, thus winning the race. If all the columns have reached the goal at a time, medals are paid as if the player has bet equally on all columns in accordance with the win system. It is possible to set a plurality of imaginary balls of identical numeral and color in the column. Such a setting of imaginary balls offers a greater chance of outrunning which may occur depending on the color and the numeral of the last extracted ball, thus maintaining the fun of the game to the last of the race.

In the described embodiment of the present invention, the circulation of the water is created by the flow of water forcibly generated by an upwardly converging nozzle. This, however, is not exclusive and the circulation of water may be effected by creating a downward forced flow of water by means of a nozzle disposed at an upper portion of the machine. In such a case, it is necessary that the balls have a specific gravity smaller than that of the ball B.

It is also to be noted that the balls need not have the same specific gravity. The specific gravity of the balls B may be varied in a random manner or a different specific gravity is intentionally set for selected ball or balls, so as to impart specific characteristics to independent game machines.

Obviously, the guide rail 422, which is composed of a pair of pipes, may be substituted by a trough-like member having a semi-circular or an arcuate cross-section.

Although the sensor elements used in the reading sections 5, 5' are magnetic sensors, it is possible to use optical sensors in place of such magnetic sensors. In such a case, optically sensible codes are formed in various directions, e.g., in three orthogonal directions, on the surface of each ball B, so that the codes can safely be read regardless of the orientation of the ball B in a proximal manner by a sensor such as, for example, a CCD scanner. It is also possible to form a specific optically readable pattern on the surface of the ball, the read pattern being then converted into the information peculiar to the ball, i.e., the numeral and the color.

The operation of the game machine in accordance with the invention in each game mode will now be described with reference to flow charts shown in FIGS. 19 to 30.

Figure 19:
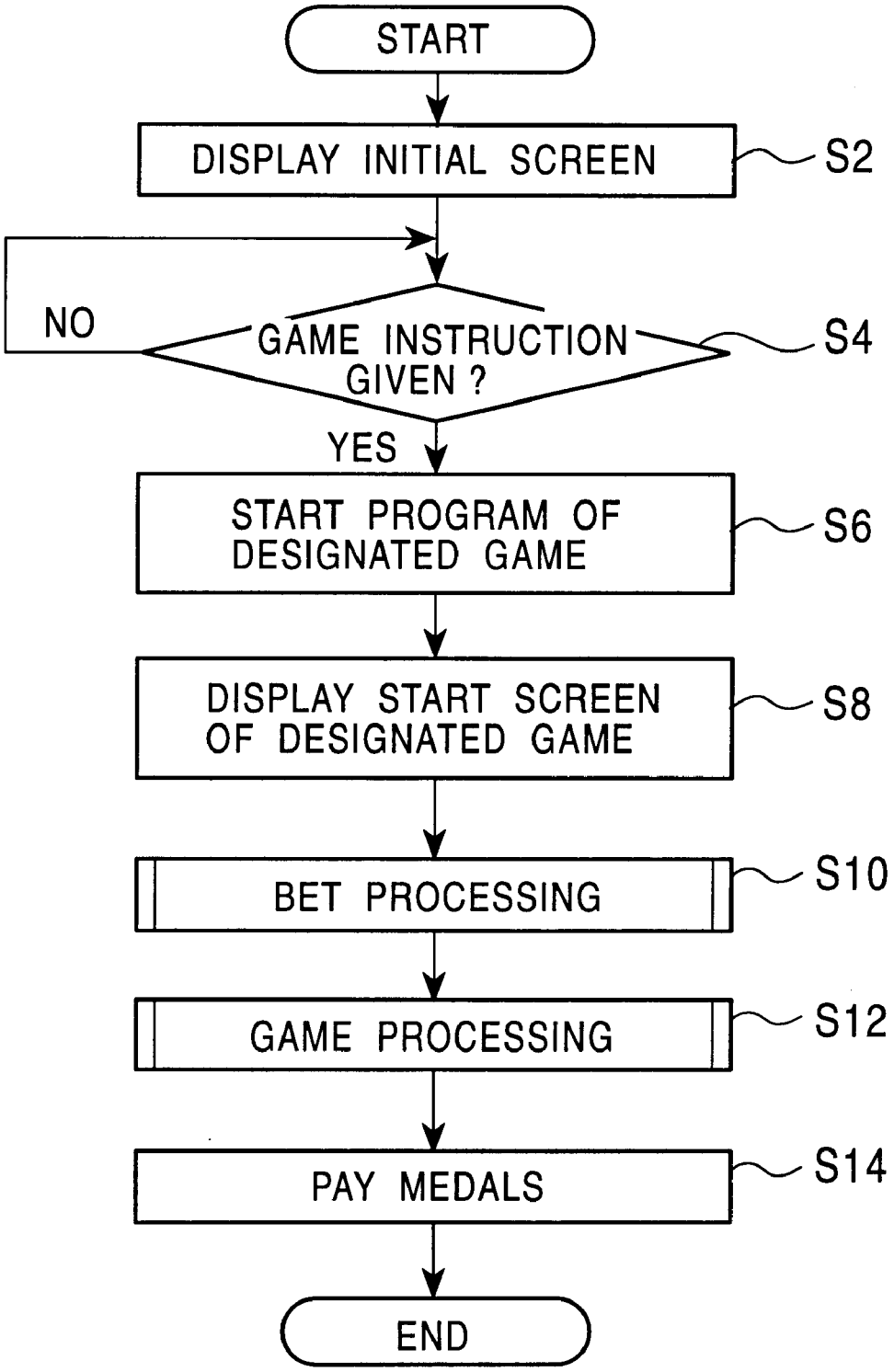
FIG. 19 is a flow chart of a main routine of operation of the game machine of the present invention.

FIG. 19 illustrates the main routine. As the power is turned on, the initial screen shown in FIG. 14 is displayed (Step S2), and the game machine is ready for receiving instruction for specifying the type of the game (Step S4). The player then designates a game through the touch panel 111*d*, so that the program of the designated game is picked up from among the game programs stored in the ROM 121 and started (Step S6), whereby the initial screen of the designated game is displayed (Step S8). Then, the player bets by suitably operating the bet button 111*f* and menu regions displayed in the form of icons, whereby a bet processing is commenced (Step S10). Different bet processings are performed in different games. The bet processings, therefore, will be described later separately for the respective games. The CPU starts the game upon completion of the bet processing. so that a game processing is commenced (Step S12). Different game processings are performed in different games. The game processings, therefore, will be described later separately in connection with the descriptions of the bet processings for the respective games. When the game is over, a score is given in accordance with the results of the play, and medals of a number corresponding to the score is paid off (Step S14), whereby one cycle of the play is completed.

Sub-routines for implementing the bet processing and the game processing of each type of the game will now be described.

Figure 20:
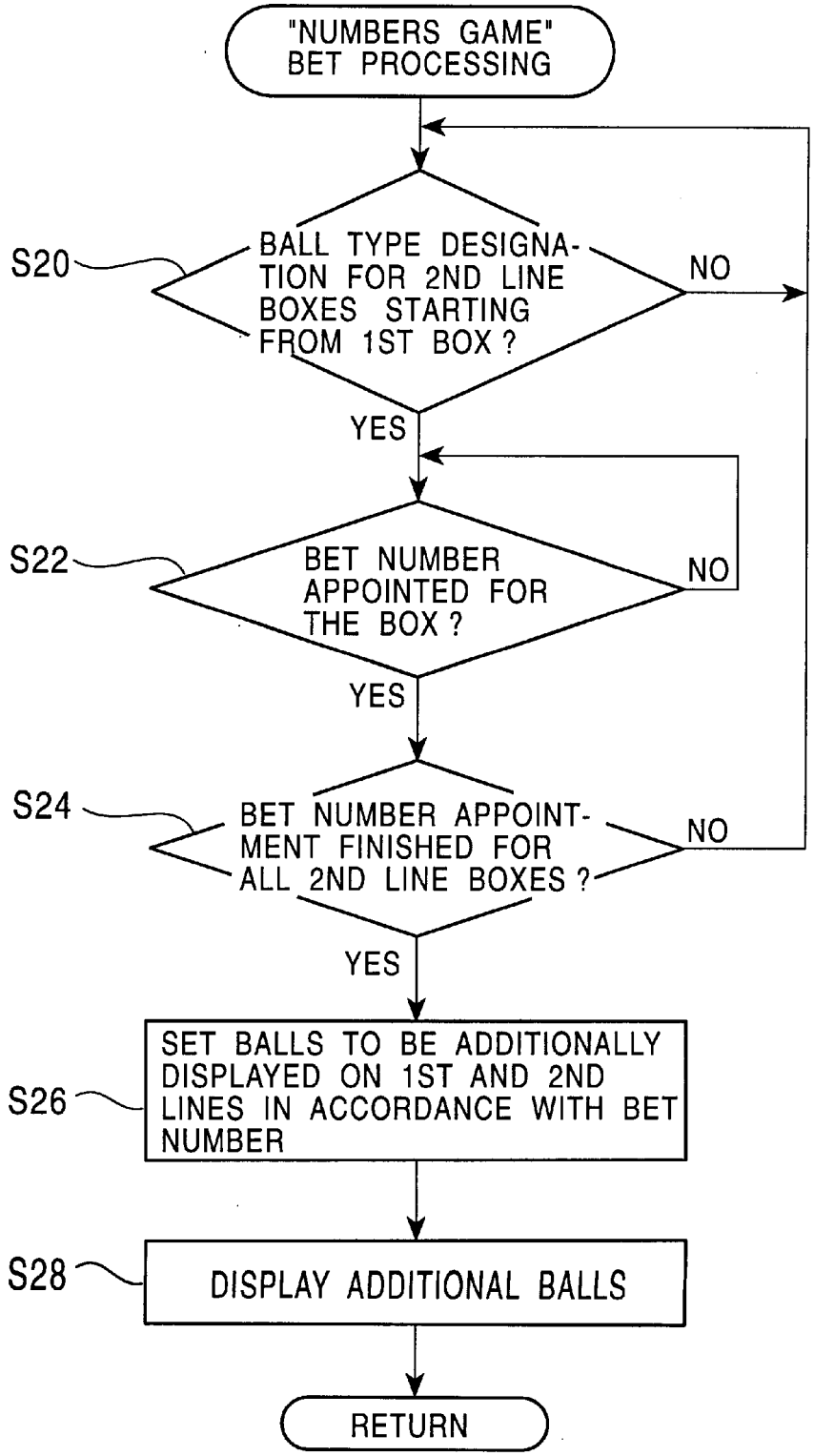
FIG. 20 is a flow chart of a sub-routine for bet processing in the NUMBERS GAME.

The bet processing sub-routine in the NUMBERS GAME will be described first with reference to FIGS. 15 and 20. In this sub-routine, bets are placed on the three boxes which constitute the second, i.e., the central line of the matrix formed of three lines as shown in FIG. 15. More specifically, bet is placed first on the first box, i.e., the box of the first or left column. To this end, the player touches the BET menu on the display, and selects only one type of ball having a specific numeral and color by a touch on the display from among 30 types of balls which are identified both by color and numeral (Step S20). Then, the player inputs the number of the medals to be bet, by suitably using the 1 BET and/or 5 BET menus. Then, a determination is conducted as to whether the bet button 111*f* has been pressed (Step S22). Subsequently, a determination is performed as to whether the foregoing operation has been completed for all of the three boxes of the second line (Step S24). If the operation has been completed to the third box, i.e., the right box, of the second line, the process advances to Step S26. This sub-routine may be modified such that Step S26 is started when a predetermined time set by a timer has lapsed after completion of Step S24, so that the player can change the bets during the period afforded by the timer.

Step S26 sets the number of balls to be additionally displayed in the first and third lines, in accordance with the number of the medals bet by the player. The process then proceeds to Step S28 which additionally displays the balls set in Step S26. The process then returns. The additional balls appear in the first line in response to a predetermined increment of the number of bets, and, in response to a further increment, additional balls are displayed in the third line. Thus, the number of the balls displayed increases when the player bets greater number of medals, so that the chance of hit increases in accordance with the increase in the number of bets, whereby the game is rendered more exciting.

For instance, when the number of the medals bet is not less than 10 but less than 20, balls are additionally displayed in the boxes of the first line and, when the number of the medals bet is 20 or more, additional balls are displayed also in the third line. As stated before, the balls additionally displayed in the first line provide the same color sequence as the second line, and the numerals of these additional balls are smaller by one than the balls of the corresponding columns in the second line. Similarly, the balls additionally displayed in the third line provide the same color sequence as the second line, and the numerals of these additional balls are greater by one than the balls of the corresponding columns in the second line. The game is started unless a CANCEL menu is touched within a predetermined period of time after the display of the additional balls.

Figure 21:
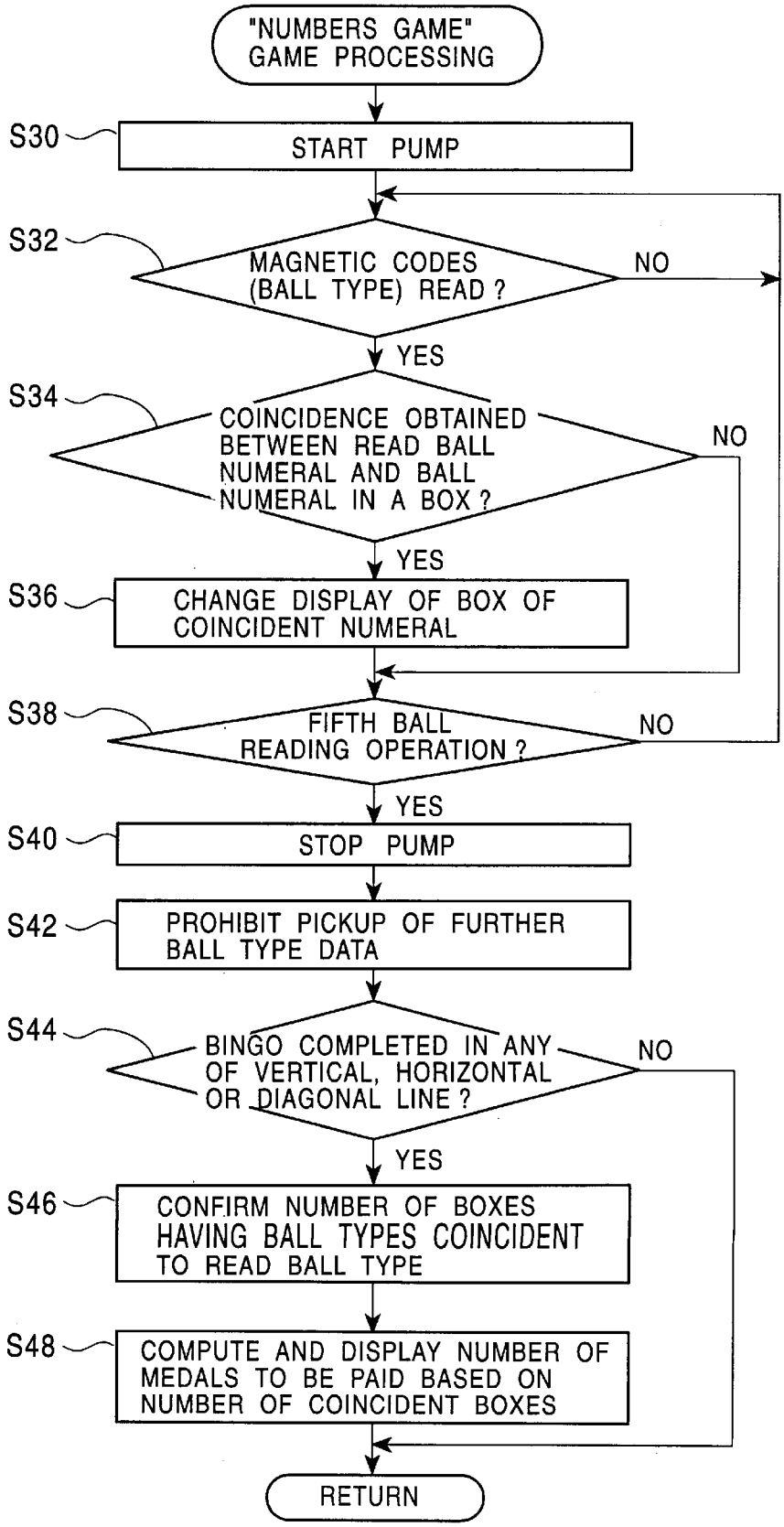
FIG. 21 is a flow chart of a sub-routine for game processing in the NUMBERS GAME.

A description will now be given of the game processing sub-routine for the NUMBERS GAME, with reference to FIGS. 15 and 21. After the completion of the bet processing, the pump P is started to commence the game (Step S30). As a result of the operation of the pump P, an upward flow of water is created in the tubular structure 40, so that 30 balls B stagnant on the ceiling 602 or therearound are trapped and conveyed by the upward flow of the liquid through the tubular structure 40. The balls B freed from the tubular structure 40 are then scattered in all directions to gradually sink or move downward through the region around the tubular structure 40. Most of the balls are caught by the guide rail 422 during their downward movement. These balls roll down along the guide rail 422 and leave the lower end of the guide rail 422. Some of the balls B which have left the lower end of the guide rail 422 directly fall onto the ceiling 602. However, any ball which leaves the lower end of the guide rail 422 at the very moment at which the lower end of the guide rail 422 faces the reading portion 5 is introduced into the reading portion 5 so as to be "extracted", and the magnetic codes indicative of the numeral and color of the ball B, indicative of the ball type, are read by the reading portion 5. Thus, an answer YES is given to the question posed in Step S32.

Then, a determination is conducted as to whether a ball having the same numeral as that of the detected ball is displayed in any of the displayed boxes (Step S34). If no such ball exists in the displayed boxes, the process skips to Step S38, whereas, if a ball having the numeral coincident to that of the extracted ball exists on the display, the mode of display of such a ball is highlighted, flickered or otherwise changed to indicate the fact of coincidence (Step S36). The process then advances to Step S38 which determines whether or not the ball type reading operation has been conducted five times. If the number of the ball type reading operations which have been executed has not yet reached 5, the process returns to Step S32 so that the operation is conducted for extracting and reading a next ball. Conversely, of the number of the ball type reading operations has reached 5, the pump P is stopped (Step S40). Thereafter, no further ball data is taken up, even when a sinking ball immediately after the stop of the pump has happened to pass through the ring 52 of the reading portion 5 (Step S42). Electrical power supply to the sensor 51 also may be turned off.

The process then proceeds to Step S44 which determines whether the numerals read from the extracted five balls can form a numeral series which is coincident to the numeral series of at least one of the eight lines, i.e., three horizontal lines (lines), three vertical lines (columns) and two diagonal oblique lines, of the displayed matrix, thus determining whether or not a bingo has been completed in any of these lines. The process returns if no such line exists, whereas, if there is at least one line in which bingo has been completed, the process advances to Step S46.

Step S46 counts the number of the boxes having balls the types (colors and numerals) of which coincide with those of the extracted balls. The process then advances to Step S48 which computes the number of the medals to be paid, based on the number of the coincident boxes, and the resultant number is displayed in the frame PAID on the display. For instance, if coincidence has been obtained with three or more out of the five extracted balls, the number of the medals paid is the number of bet medals multiplied by 100. A minimum multiplication factor of 10 applies, even though there is no coincident box.

Figure 22:
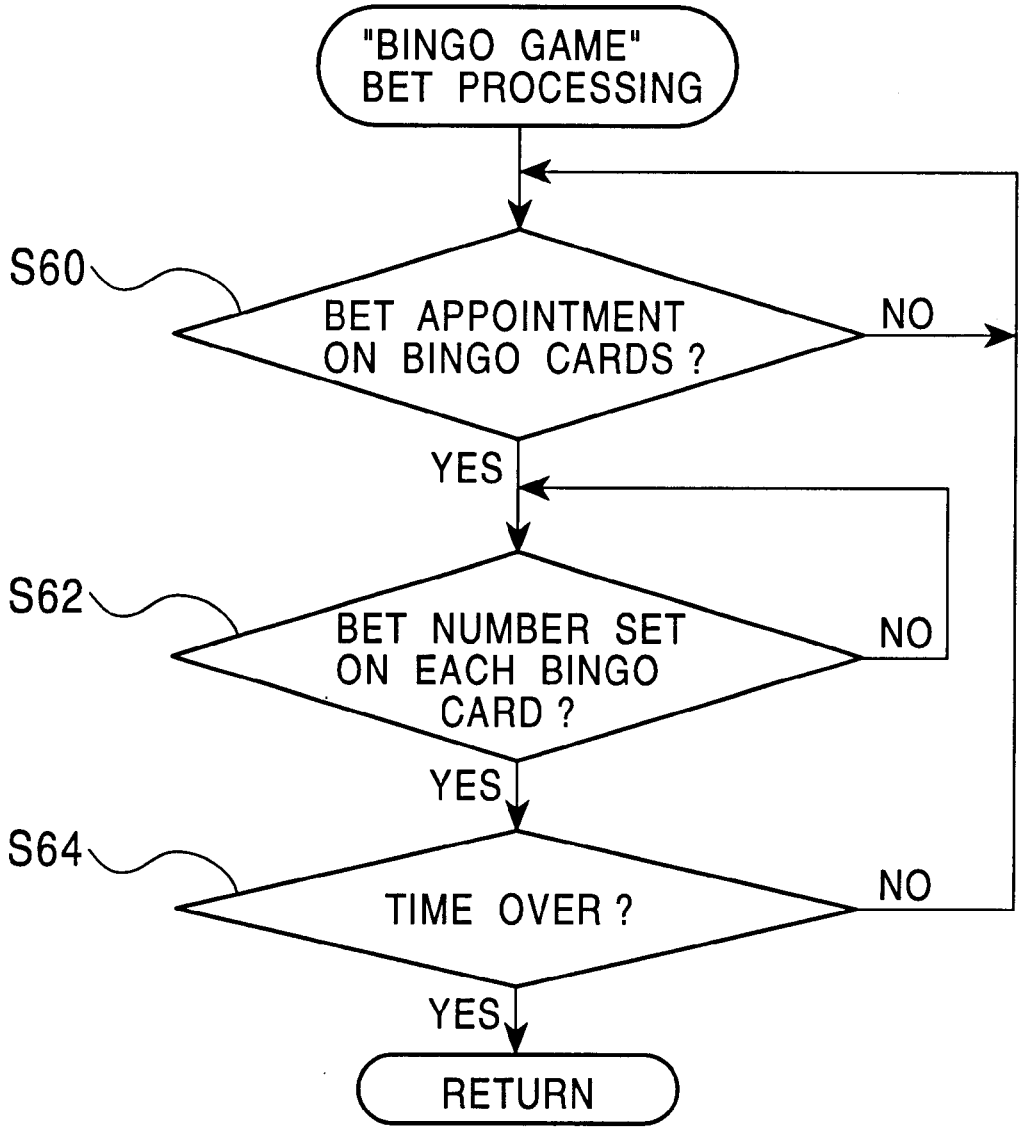
FIG. 22 is a flow chart of a sub-routine for bet processing in the BINGO GAME.

A description will now be given of the bet processing sub-routine for the BINGO GAME, with reference to FIGS. 16 and 22. In accordance with this sub-routine, three bingo cards which have been obtained at random are displayed on the screen. The player inputs a bet appointing instruction for each bingo card by touching a BET menu associated with the bingo card (Step S60), followed by inputting of the number of bets through the use of the 1 BET and/or 5 BET menu. The player then pushes the bet button 111*f* (Step S62). A timer is reset and started upon completion of the appointment of the bet number for each bingo card. Step S64 determines whether the period of time set by the timer has expired. If the player conducts the operation for betting on the next bingo card within the time period set by the timer, the process returns to Step S60 to enable the player to bet on the next bingo card. The player also can change the number bet on each card by touching a CANCEL menu within the above-mentioned period of time. Conversely, recognition of no operation by the player before the expiration of the set time is regarded by the CPU as being completion of the betting operation, and returns the process. The number of the bet medals are shown below each bingo card for confirmation.

The player can bet all the deposited medals, i.e., the medals credited to the player, to any desired bingo card, by touching the ALL BET menu.

Figure 23:
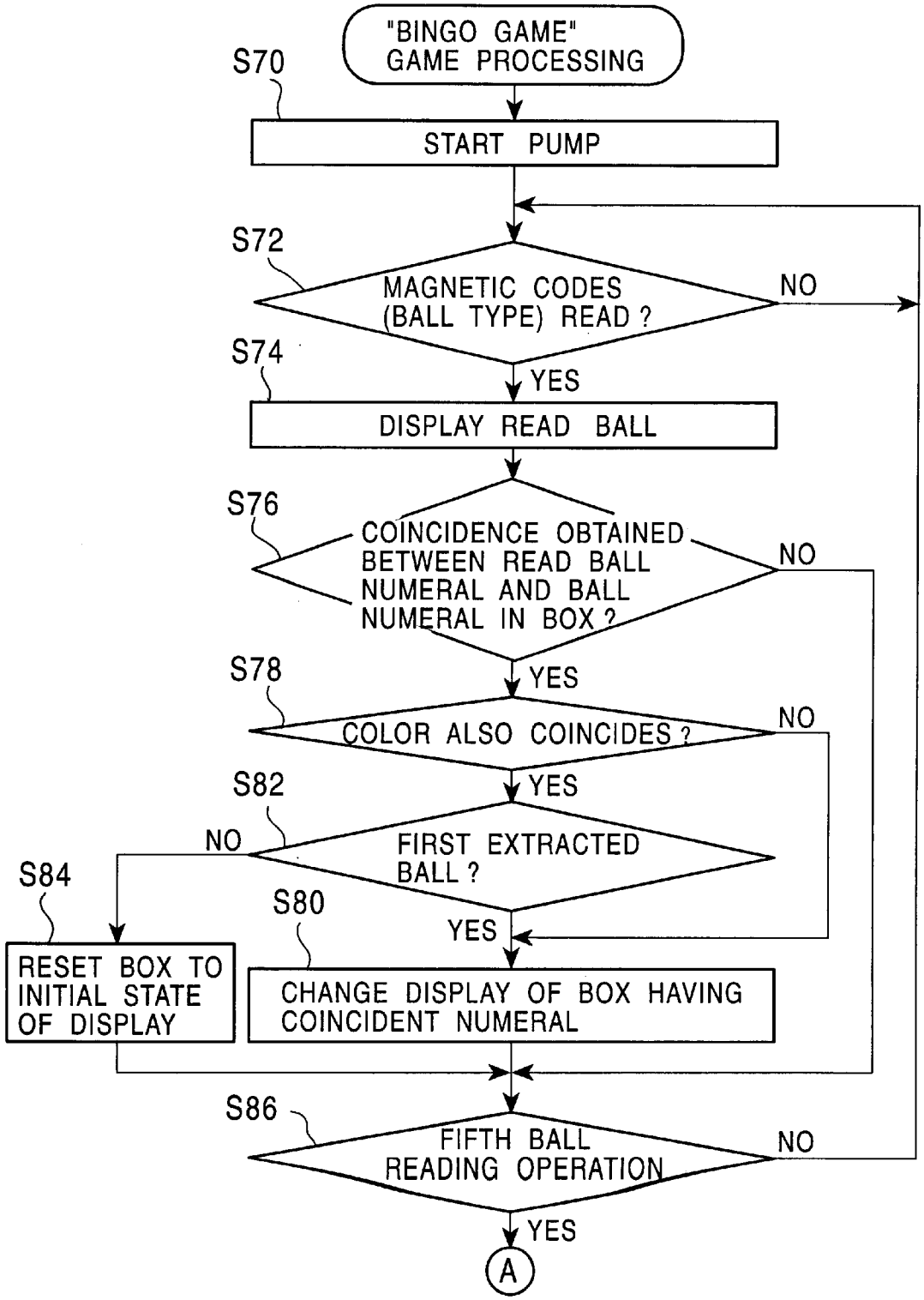
FIG. 23 is a flow chart of a sub-routine for game processing in the BINGO GAME.
Figure 24:
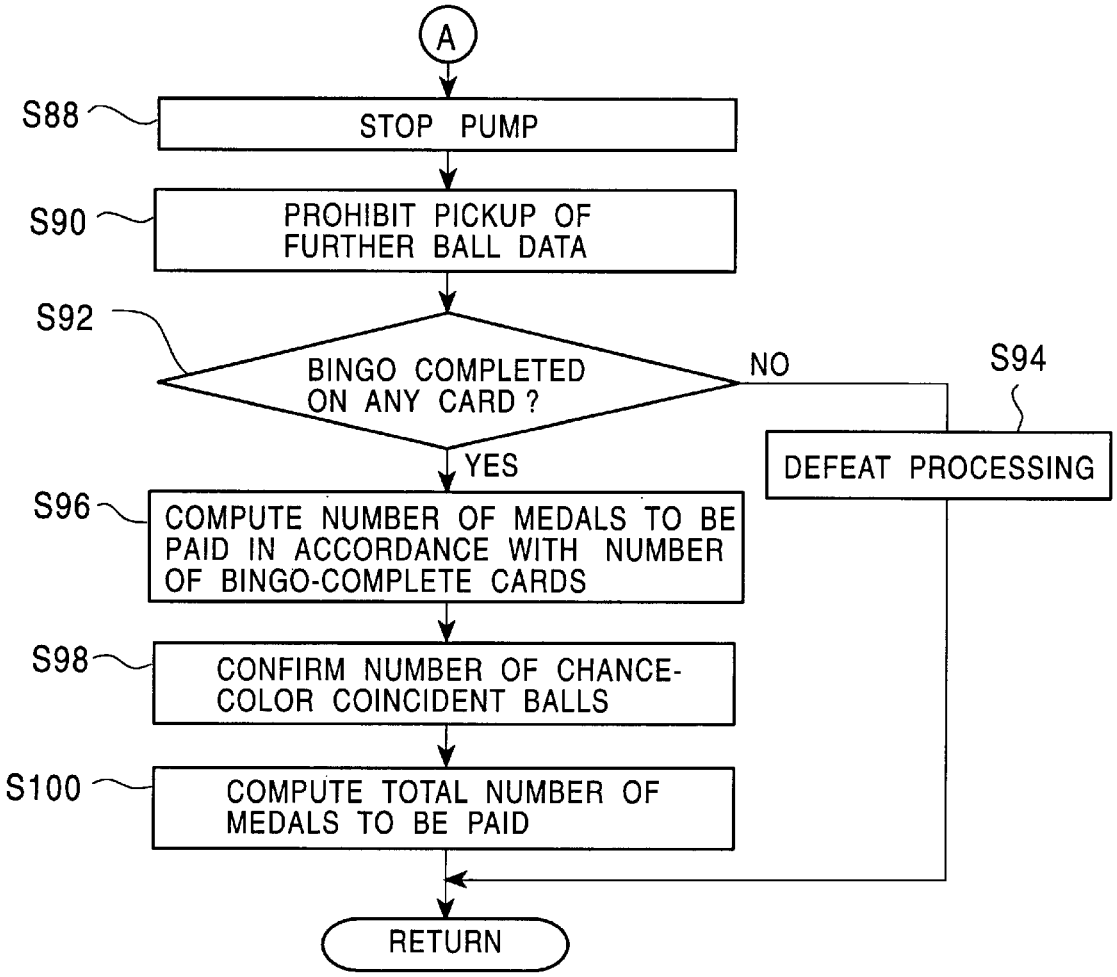
FIG. 24 is a flow chart of a sub-routine for game processing in the BINGO GAME.

The game processing sub-routine for the BINGO GAME will now be described with reference to FIG. 16 and FIGS. 23 and 24. After the completion of the bet processing, the pump P is started to commence the game (Step S30). As a result of the operation of the pump P, an upward flow of water is created in the tubular structure 40, so that 30 balls B stagnant on the ceiling 602 or therearound are trapped and conveyed by the upward flow of the liquid through the tubular structure 40. The balls B freed from the tubular structure 40 are then scattered in all directions to gradually sink or move downward through the region around the tubular structure 40. Most of the balls are caught by the guide rail 422 during their downward movement. These balls roll down along the guide rail 422 and leave the lower end of the guide rail 422. Some of the balls B which have left the lower end of the guide rail 422 directly fall onto the ceiling 602. However, any ball which leaves the lower end of the guide rail 422 at the very moment at which the lower end of the guide rail 422 faces the reading portion 5 is introduced into the reading portion 5 so as to be "extracted", and the magnetic codes indicative of the numeral and color of the ball B, indicative of the ball type, are read by the reading portion 5. Thus, an answer YES is given to the question posed in Step S72. The types of the balls thus read by the reading portion are displayed in the order in the form of balls, in a frame which is set at left upper portion of the screen (Step S74).

Then, a determination is conducted as to whether a ball having a numeral coincident to that of the detected ball is displayed in any of the displayed boxes (Step S76). If there is no coincident numeral, the process skips to Step S86, whereas, if there is a coincident numeral, the process advances to Step S78 which determines whether or not a coincidence of color has also been obtained with the ball having the coincident numeral. If the color of the extracted ball does not coincide with the displayed ball having the coincident numeral, the process skips to step S80. However, if coincidence of color also is confirmed with the ball having the coincident numeral, the process proceeds to Step S82 which determines whether or not this ball has been extracted for the first time in the instant play. If this ball has been extracted for the first time in the play, the process advances to Step S80. Step S80 effects a change in the mode of display of the box in which this ball id displayed, e.g., by highlighting or flickering. As stated before, in the game machine of the present invention, there is a possibility that any ball is extracted twice or more in a single play of the game, because each extracted ball is brought again into the circulation of the liquid together with other balls. When the determination in Step S82 has proved that the extraction is a second extraction of an identical ball, the process advances to Step S84 in which the data obtained through an n-th extraction (n being an odd number), e.g., the first extraction, is canceled in response to the (n+1)-th extraction, e.g., the second extraction, of an identical ball. The cancellation is conducted by resetting the boxes to the states which had been taken before the change of the display mode.

Then, a determination is conducted as to whether the number of the reading operations which have been conducted has reached 5 (Step S86). If the number 5 has not yet been reached, the process returns to Step S72 so that steps are followed to extract and read the next ball. However, if the number has reached 5, the pump P is stopped (Step S88) and pickup of further ball data is prohibited even though any sinking ball has happened to pass through the ring 52 of the reading portion 5 immediately after the stop of the pump (Step S90).

Then, Step S92 is executed to confirm whether there is any bingo card on which a bingo has been completed with the numerals of the extracted five balls, and to confirm also the number of the bingo cards in which bingo has been completed. Obviously, the confirmation of the number of the cards which has achieved bingo is conducted only with respect to the cards on which bets have been placed by the player. Then, the number of medals to be paid is computed based on the number of the cards which have achieved bingo (Step S96). Then, the number of times of coincidence between the color of the extracted ball and the chance color which is set automatically for each extraction of ball is confirmed (Step S98) and the total number of the medals to be paid is computed based on the chance color multiplication factor (Step S100). The process then returns. When no bingo has been achieved in the cards, a defeat processing is conducted (Step S94) and then the process returns to the initial step.

Figure 25:
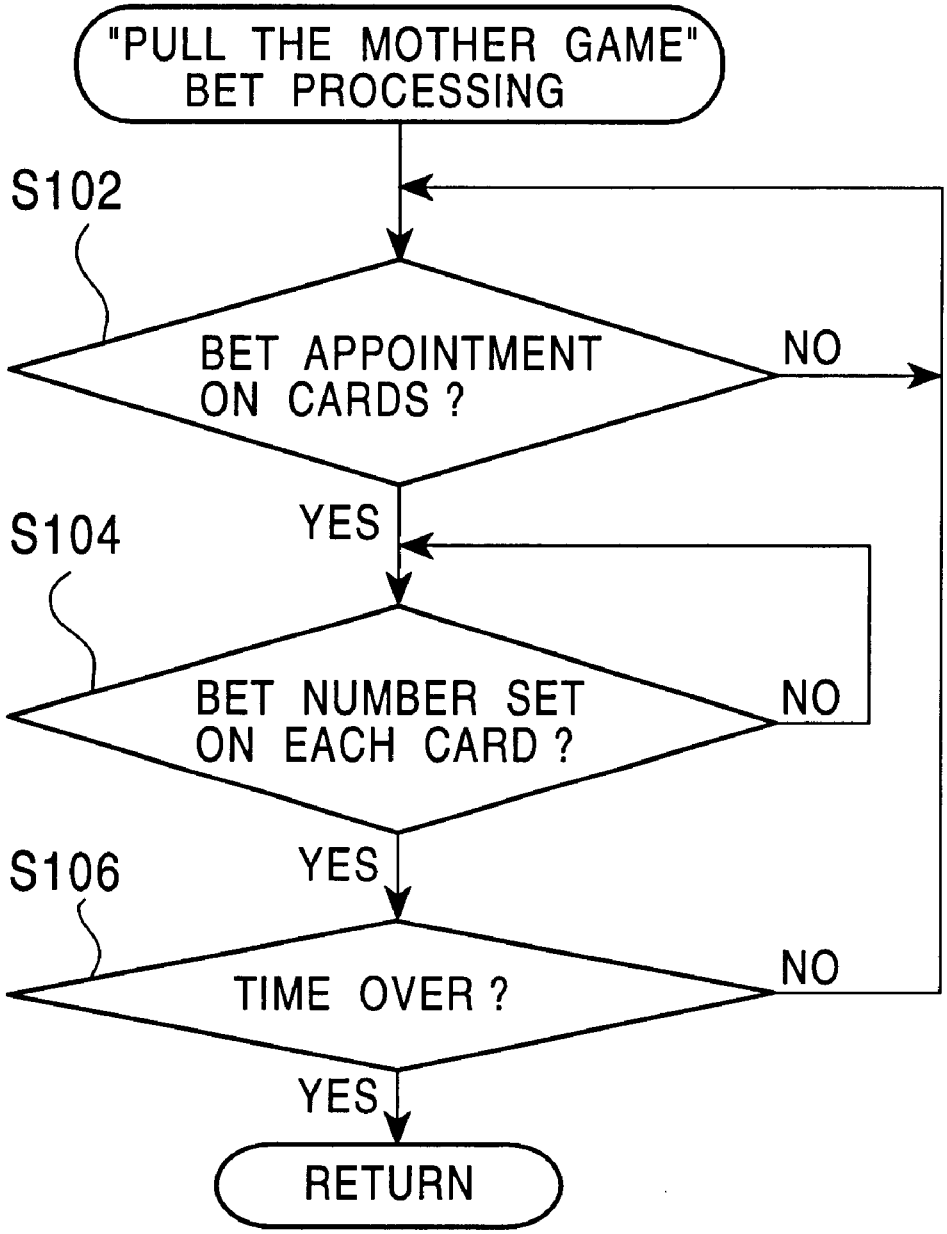
FIG. 25 is a flow chart of a sub-routine for bet processing in the PULL THE MOTHER GAME.

A description will now be given of the bet processing sub-routine for the PULL THE MOTHER GAME, with reference to FIGS. 17 and 25. In accordance with this sub-routine, three cards which have been obtained at random are displayed on the screen. The player inputs a bet appointing instruction for each card by touching a BET menu associated with the card (Step S102), followed by inputting of the number of bets through the use of the 1 BET and/or 5 BET menu. The player then pushes the bet button 111*f* (Step S104). A timer is reset and started upon completion of the appointment of the bet number for each card. Step S106 determines whether the period of time set by the timer has expired. If the player conducts the operation for betting on the next card within the time period set by the timer, the process returns to Step S102 to enable the player to bet on the next card. The player also can change the number of bet on each card by touching a CANCEL menu within the above-mentioned period of time. Conversely, recognition of no operation by the player before the expiration of the set time is regarded by the CPU as being completion of the betting operation, and returns the process. The number of the bet medals are shown below each card for confirmation.

As in the case of the BINGO GAME described before, this routine may be terminated on condition that the ALL BET menu is touched subsequent to completion of the bet operation on at least one card.

Figure 26:
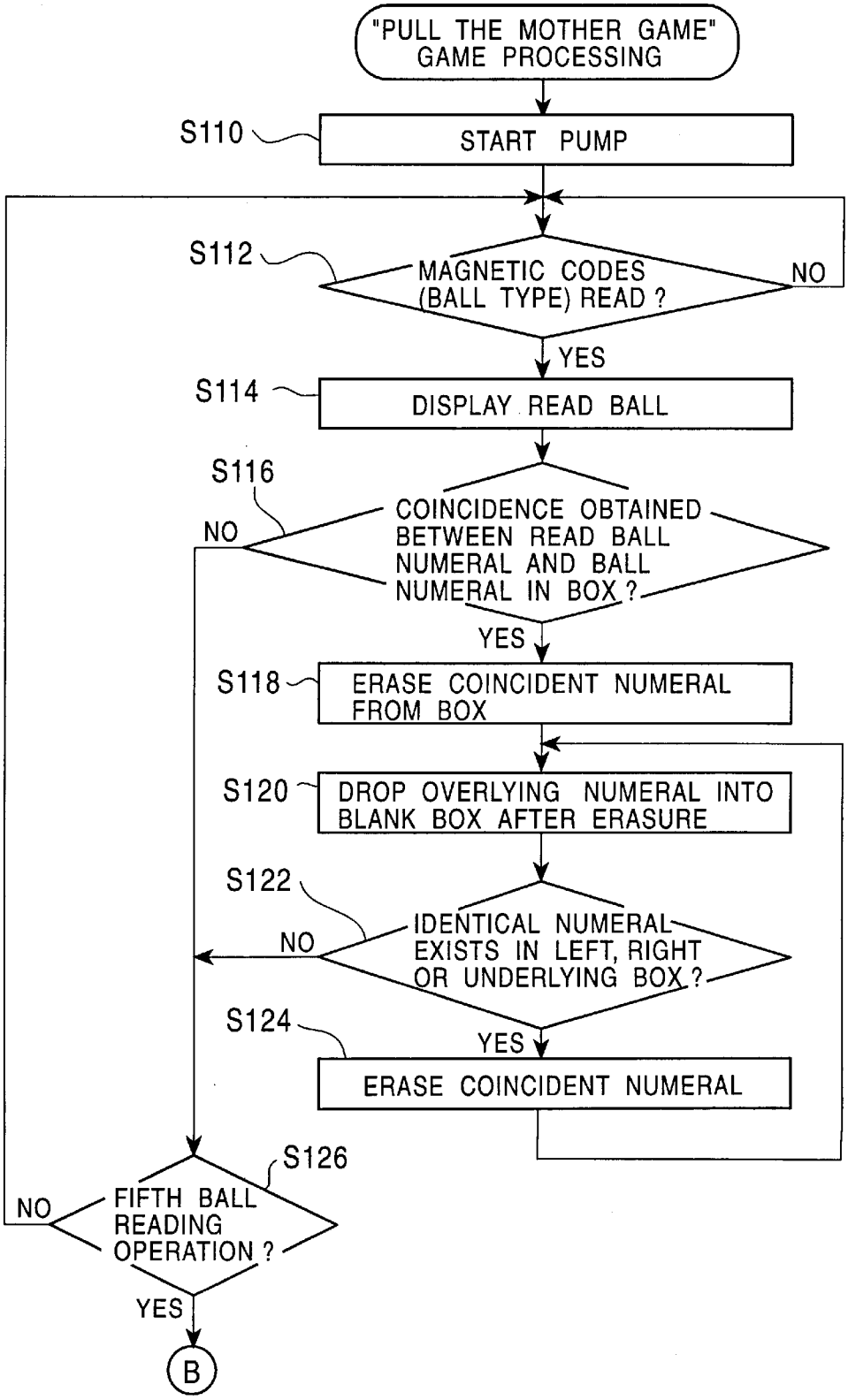
FIG. 26 is a flow chart of a sub-routine for game processing in the PULL THE MOTHER GAME.
Figure 27:
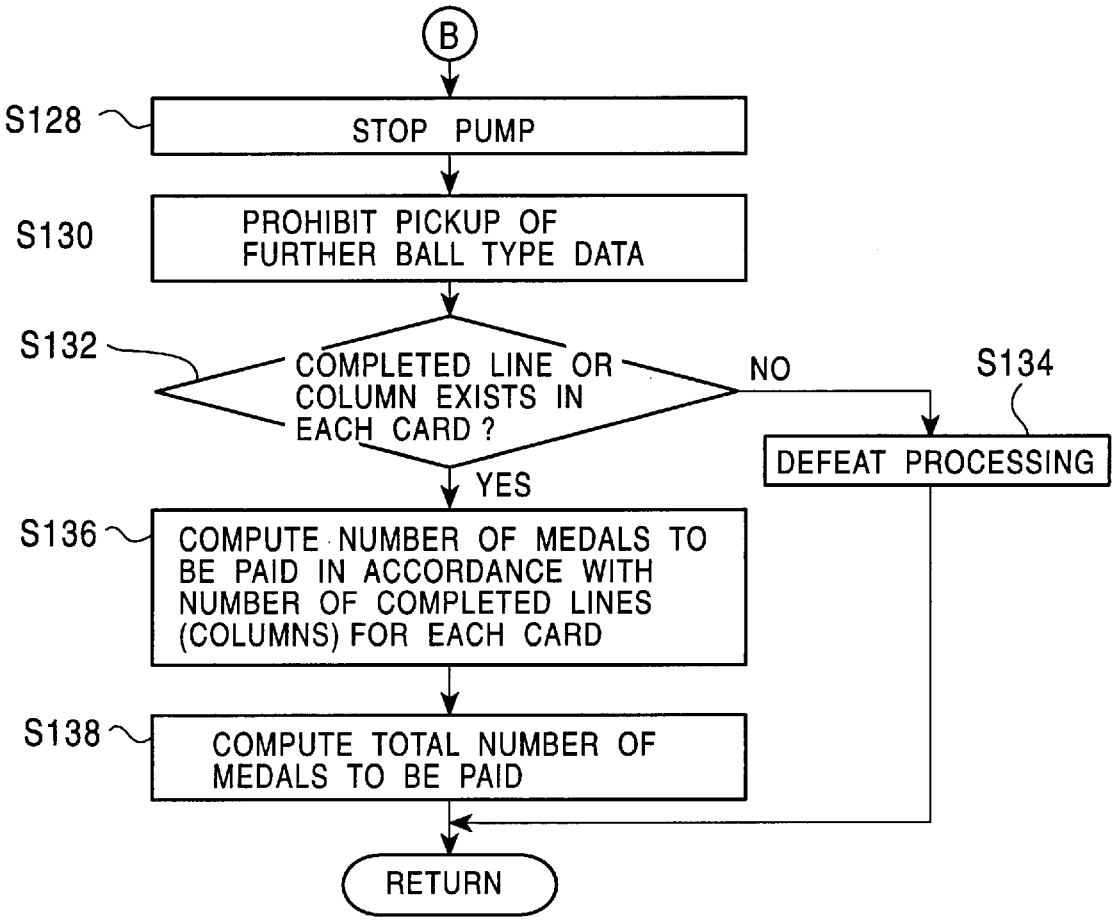
FIG. 27 is a flow chart of a sub-routine for game processing in the PULL THE MOTHER GAME.

The game processing sub-routine for the PULL THE MOTHER GAME will now be described with reference to FIGS. 26 and 27. After the completion of the bet processing, the pump P is started to commence the game (Step S110). As a result of the operation of the pump P, an upward flow of water is created in the tubular structure 40, so that 30 balls B stagnant on the ceiling 602 or therearound are trapped and conveyed by the upward flow of the liquid through the tubular structure 40. The balls B freed from the tubular structure 40 are then scattered in all directions to gradually sink or move downward through the region around the tubular structure 40. Most of the balls are caught by the guide rail 422 during their downward movement. These balls roll down along the guide rail 422 and leave the lower end of the guide rail 422. Some of the balls B, which have left the lower end of the guide rail 422, directly fall onto the ceiling 602. However, any ball which leaves the lower end of the guide rail 422 at the very moment at which the lower end of the guide rail 422 faces the reading portion 5 is introduced into the reading portion 5 so as to be "extracted", and the magnetic codes indicative of the numeral and color of the ball B, indicative of the ball type, are read by the reading portion 5. Thus, an answer YES is given to the question posed in Step S112. The types of the balls thus read by the reading portion are displayed in the order in the form of balls, in a frame which is set at left upper portion of the screen (Step S114).

Then, a determination is conducted as to whether there is any numeral coincident to the numeral attribute of the ball type of the extracted ball exists in the displayed boxes (Step S116). If there is no coincidence of the numeral, the process skips to Step S126, whereas, if there is any coincident numeral, the coincident numeral is deleted from the box (Step S118) so that this box is changed into a blank. Then, the stack of numerals on this box is moved downward so that this blank is filled (Step S120). For instance, when the numeral in a box of the third line has been deleted due to coincidence so as to change this box into a blank, the numeral of the second line which has been placed on the deleted numeral drops from the second line to the third line to fill the blank, while changing the box of the second line into a blank. Likewise, the numeral in the first line belonging to the same column as the deleted numeral drops from the first line to the second line to fill the blank. Consequently, the box of the first line in this column is left as a blank. In FIG. 17, the boxes of the first and second lines of the left column have been changed to blanks.

A new arrangement of numerals is thus obtained as a result of the downward shifting of the stack of numerals. Then, a determination is conducted (Step S122) as to whether or not the numeral identical to the lowermost numeral of the moved stack exists in the boxes adjacent to the lowermost numeral, i.e., the box immediately under the lowermost numeral and boxes which are on the left and right sides of the lowermost numeral, in the new arrangement of numerals stated above. If none of these three boxes has the numeral identical to the above-mentioned lowermost numeral, the process proceeds to Step S126, whereas, if any of these three boxes has such an identical numeral, the process returns to Step S120 to repeat the "packing" of the numerals, by erasing the identical numeral to change the box into a blank and then filling the blank box with the overlying numeral.

Then, a determination is conducted as to whether the number of the reading operations which have been conducted has reached 5 (Step S126). If the number 5 has not yet been reached, the process returns to Step S112 so that steps are followed to extract and read the next ball. However, if the number has reached 5, the pump P is stopped (Step S128) and pickup of further ball data is prohibited even though any sinking ball has happened to pass through the ring 52 of the reading portion 5 immediately after the stop of the pump (Step S130).

The columns in which all the boxes have been changed into white blanks on each card is regarded as a "win" and the number of such wins is counted (Step S132). Then, the number of medals to be paid is computed for each card having any "win" column, based on the number of the wins, i.e., the number of the columns in which all the boxes have been changed to white blanks (Step S136). Then, the sum of the numbers of the medals to be paid for all the cards is computed (Step S138) and then the process returns to the initial step. When there is no win, the process advances to Step S134 which executes a defeat processing.

Figure 28:
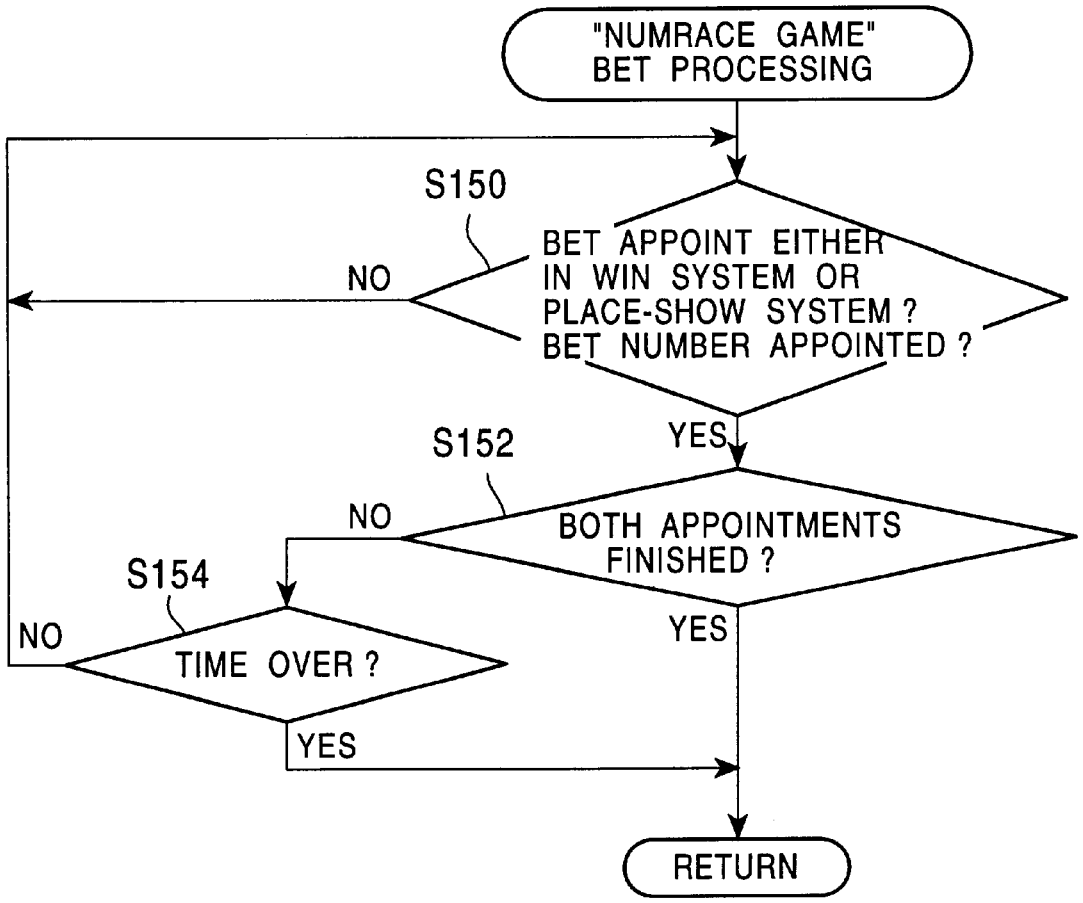
FIG. 28 is a flow chart of a sub-routine for bet processing in the NUMRACE GAME.

A description will now be given of the bet processing sub-routine of the NUMRACE GAME, with reference to FIGS. 18 and 28. In this sub-routine, a game area having 6 columns (columns Nos. 1 to 6) is displayed on the display screen. A dharma mark is shown below each column. A plurality of imaginary balls selected in a random manner, having their own numerals and one of preselected colors, are set and displayed beneath the dharma mark of each column. The number of the imaginary balls which can be set in each column is variable from 1 to 4. In order to give a fair chance of win, odds are automatically set in accordance with the number of the imaginary balls, both in the win system and the place-show system.

The player then bets the medals in accordance with one or both of the win system and the place-show system, while evaluating the numbers and types of the balls in the respective columns. The operation for betting medals in accordance with the win system is as follows. The player selects any desired column by touching a column number menu located above the column, and then bets a desired number of medals by suitably using the 1 BET and 5 BET menus, followed by pressing of the bet button 111*f*. The betting operation in accordance with th place-show system is as follows. A matrix-like table displayed on the right half part of the screen contains boxes in which are displayed combinations of the column Nos. such as "1, 2", "4, 6" and so forth. The player selects any desired combination and sets a desired number of medals to be bet by using the 1 BET and 5 BET menus, so that the desired number of medals are bet on the selected combination. The player then presses the bet button 111*f*, whereby the betting operation is completed (Step S150). The player can select a single combination of the column Nos. or any desired number of combinations. In the example shown in FIG. 18, all the combinations have been selected and 50 medals have been bet equally on all the combinations. Step S152 determines whether or not the appointments, i.e., selection of combination and setting of the number of bets, have been finished both for the win system and the place-show system. The process returns when both appointments have been completed. If betting operation has not been finished either for the win system or the place-show system, the CPU waits a predetermined time (Step S154) and, if no further betting operation is conducted within the time, the CPU determines that the time is over (Step S154) to return the process. This sub-routine may be modified such that, as in the time-over determination conducted in the cases of the sub-routines shown in FIGS. 22 and 25, whether the set time period has been expired is determined in Step S152 and process returns to Step S150 if the subsequent betting operation is conducted before the expiration of the set time period, whereas, if the time is over, the process returns to the initial step.

Figure 29:
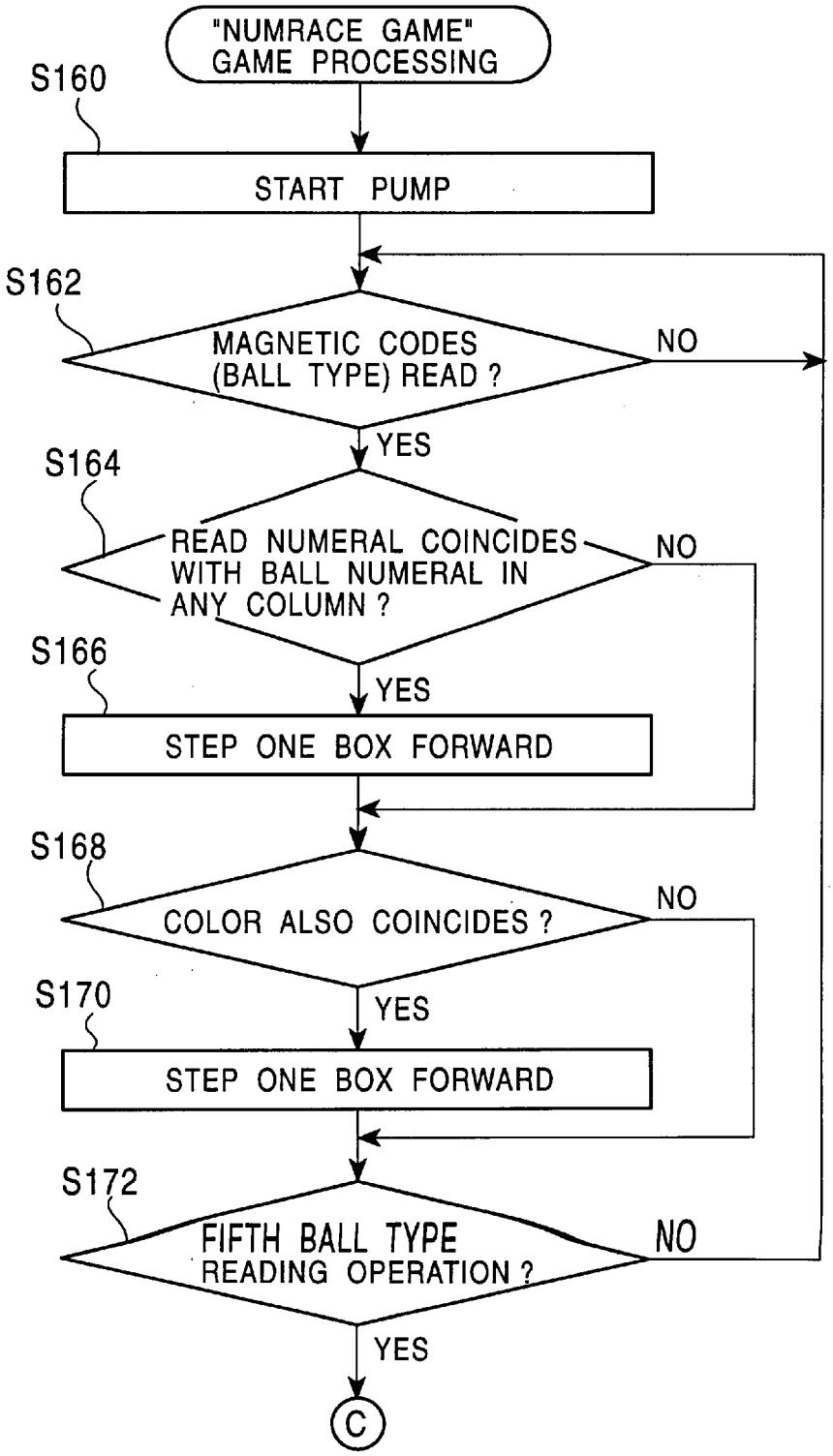
FIG. 29 is a flow chart of a sub-routine for game processing in the NUMRACE GAME.
Figure 30:
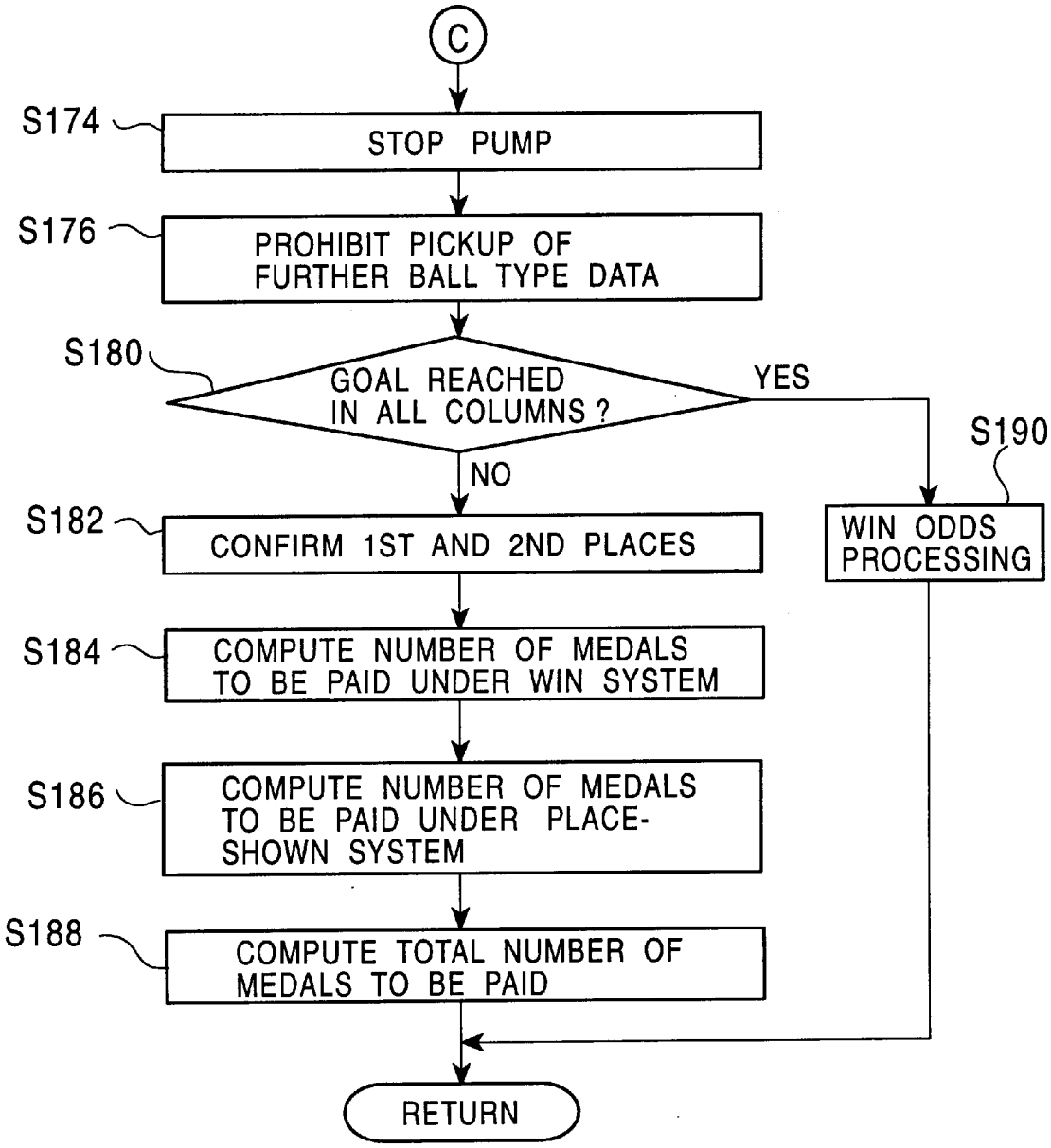
FIG. 30 is a flow chart of a sub-routine for game processing in the NUMRACE GAME.

A description will now be given of the game processing sub-routine for the NUMRACE GAME, with reference to FIG. 18 and FIGS. 29, 30. After the completion of the bet processing, the pump P is started to commence the game (Step S160). As a result of the operation of the pump P, an upward flow of water is created in the tubular structure 40, so that 30 balls B stagnant on the ceiling 602 or therearound are trapped and conveyed by the upward flow of the liquid through the tubular structure 40. The balls B freed from the tubular structure 40 are then scattered in all directions to gradually sink or move downward through the region around the tubular structure 40. Most of the balls are caught by the guide rail 422 during their downward movement. These balls roll down along the guide rail 422 and leave the lower end of the guide rail 422. Some of the balls B which have left the lower end of the guide rail 422 directly fall onto the ceiling 602. However, any ball which leaves the lower end of the guide rail 422 at the very moment at which the lower end of the guide rail 422 faces the reading portion 5 is introduced into the reading portion 5 so as to be "extracted", and the magnetic codes indicative of the numeral and color of the ball B, indicative of the ball type, are read by the reading portion 5. Thus, an answer YES is given to the question posed in Step S162.

Then, a determination is conducted as to whether there is any column having an imaginary ball of a numeral which is coincident to the numeral of the extracted ball (Step S164). If no such a column exists, the process proceeds to Step S168. However, if there is any column or columns having imaginary balls of the numeral coincident to that of the extracted ball, one frame appears in each such column starting from the bottom, so that the dharma mark makes one forward (upward) step (Step S166). Then, a further determination is conducted as to whether the color of the each imaginary ball whose numeral has been confirmed to be coincident to that of the extracted ball is the same as the color of the extracted ball (Step S168). If there is no coincidence of color, the process proceeds to Step S172, whereas, if the imaginary ball whose numeral is identical to that of the extracted ball has the same color as the color of the extracted ball, a further frame appears from the bottom of the column having such imaginary ball, so that the dharma mark in that column makes one further forward (upward) step (Step S166). Thus, when a column has an imaginary ball which is coincident not only in numeral but also in color to the extracted ball, the dharma mark in that column makes two forward (upward) steps at once.

Step S172 determines whether the number of the reading operations which have been conducted has reached 5. If the number 5 has not yet been reached, the process returns to Step S162 so that steps are followed to extract and read the next ball. However, if the number has reached 5, the pump P is stopped (Step S174) and pickup of further ball data is prohibited even though any sinking ball has happened to pass through the ring 52 of the reading portion 5 immediately after the stop of the pump (Step S176).

The process then proceeds to Step S180 which determines whether or not the dharma marks of all the columns have been reached the goal, i.e., whether they have been raised to the uppermost stage. If the goal has been reached in all the columns, a processing for payment with equal odds is conducted in accordance with the win system on all the columns, regardless of the order in which the goal has been reached in the columns. The process then returns to the initial step. However, if the goal has not yet been reached in one or more columns, an answer NO is given to the question posed in Step S180, so that the process proceeds to Step S182 which confirms the Nos. of the columns which have won the first and second places. Then, the number of medals to be paid under the win system is computed on condition that bet has been placed on the column which has won the first place (Step S184). Then, the number of the medals to be paid under place-show system is computed based on the combination of the Nos. of the columns which have won the first and second places, on condition that the bet has been made also by the place-show system (Step S186). The process then proceeds to Step S188 which computes the sum of the number of medals to be paid under the win system and the number of medals to be paid under the place-show system.

Although the invention has been described in its specific forms, it is to be understood that the described embodiments are only illustrative and various changes and modifications are possible without departing from the scope of the present invention which is limited solely by the appended claims.

What is claimed is:

1. A video game machine having a display screen, a certain number of object pieces, and an extraction mechanism which extracts a specific number of the object pieces at random from among the certain number of the object pieces, each of the object pieces having specific information peculiar thereto, and a reading device for reading the specific information of the extracted object pieces, wherein when the specific information read from the extracted object pieces has relevancy to specific information displayed on said display screen, scores are given in accordance with degrees of the relevance, said video game machine comprising:

a matrix displaying means for displaying a matrix of boxes on said display screen;

input displaying means for enabling a player to arbitrarily allocate object marks having specific information peculiar thereto to respective ones of said boxes of a preselected line of said matrix, and for displaying said object marks in the respective boxes of said preselected line;

automatic displaying means for automatically allocating, in the boxes of remaining lines of said matrix, object marks each having specific information peculiar thereto and related to the specific information of the object marks allocated in a corresponding box of said preselected line by the player having used said input displaying means;

first determining means for determining whether or not the specific information peculiar to the extracted object pieces coincide with the specific information of any of the object marks displayed on the display screen in said matrix of boxes;

display mode changing means for changing a mode of display of said object marks only for ones of the object marks with which coincidence of the specific information has been determined by said first determining means;

second determining means for determining whether or not the object marks displayed in the changed display mode complete any line of boxes of said matrix; and scoring means for giving a score when any one line has been completed with the object marks displayed in the changed display mode.

2. The video game machine according to claim 1, further comprising means for displaying, on said display screen, statistic data relating the specific information extracted in previous plays of the game.

3. A video game machine having a display screen, a certain number of object pieces, and an extraction mechanism which extracts a specific number of the object pieces at random from among the certain number of the object pieces, each of the object pieces having specific information peculiar thereto, and a reading device for reading the specific information of the extracted object pieces, wherein when the specific information read from the extracted object pieces has relevancy to specific information displayed on said display screen, scores are given in accordance with degrees of the relevance, said video game machine comprising:

bingo card displaying means for displaying on said display screen one or more bingo cards each having n number of boxes arranged in a matrix and for allocating arbitrarily specific information to n–m number of said boxes and a predetermined mark to m number of said boxes where m<n;

first determining means for determining whether the specific information peculiar to the extracted object pieces coincides with the specific information in any of the (n–m) boxes of the displayed matrix;

display mode changing means for changing a mode of display of said object marks determined to have coincidence of said specific information with the specific information of the extracted object pieces determined by said first determining means;

second determining means for determining whether or not the object marks displayed in the changed mode complete any line of boxes of the matrix wherein boxes having said predetermined mark are considered as having an object mark displayed in the changed mode without coincidence with specific information of the extracted object pieces; and scoring means for awarding a player a win when said second determining means determines that any line is complete.

4. A video game machine having a display screen, a certain number of object pieces, and an extraction mechanism which extracts a specific number of the object pieces at random from among the certain number of the object pieces, each of the object pieces having specific information peculiar thereto, and a reading device for reading the specific information of the extracted object pieces, wherein when the specific information read from the extracted object pieces has relevancy to specific information displayed on said display screen, scores are given in accordance with degrees of the relevance, said video game machine comprising:

displaying function for displaying on said display screen a plurality of lines of boxes wherein the lines are disposed parallel and adjacent each other and have first and second ends aligned with one another and for allocating in a random manner specific information to these boxes having coincidence with the specific information of individual ones of the object pieces;

first determining means for determining whether the specific information read from the extracted object pieces coincides with any of the specific information displayed in said boxes;

shift display means for removing the specific information from ones of said boxes which has coincidence with the specific information of the extracted object pieces and, in each of said lines, for shifting from one of said boxes to a next one of said boxes the specific information in other ones of said boxes, located between said ones of said boxes and said second ends, toward said first ends, such that said specific information remains in contiguous ones of said boxes in each of said lines extending from said first ends and so that a number of boxes without the specific information exist in each of said lines corresponding in number to said ones of said boxes having had the coincident information in each one of the lines are left in said line, extending contiguously from said second ends, as a result of the shifting of said specific information;

second determining means for determining whether or not there is a line in which all the boxes are boxes without the specific information; and scoring function for scoring as a win any line which the second determining means has determined contains all boxes without the specific information.

5. A video game machine having a display screen, a certain number of object pieces, and an extraction mechanism which extracts a specific number of the object pieces at random from among the certain number of the object pieces, each of the object pieces having specific information peculiar thereto, and a reading device for reading the specific information of the extracted object pieces, wherein when the specific information read from the extracted object pieces has relevancy to specific information displayed on said display screen, scores are given in accordance with degrees of the relevance, said video game machine comprising:

displaying means for displaying on said display screen a plurality of areas having first and second ends at opposite sides thereof;

specific information displaying function for allocating and displaying for each of said areas an arbitrary number between 1 and m of the specific information selected in a random manner;

first-place inputting means for permitting a player to select one of the areas which the player forecasts to win a first place;

first determining means for determining whether any of the areas has the specific information coincident to the specific information read from the extracted object pieces;

stepwise displaying means for displaying in the areas determined to have coincident specific information ones of a predetermined mark contiguously extending from the first ends toward the second ends wherein lines of the predetermined mark are formed in a stepwise manner as the object pieces are extracted;

first-place detecting means for detecting at least one of the areas in which a number of the predetermined marks has reached a predetermined number, prior to other ones of said areas;

second determining means which determines whether or not the at least one of said areas detected by the first-place detecting means coincides with the select one of said areas which the player has forecast and appointed as being the first-place winner by the first-place inputting means; and scoring means for providing a score when coincidence between said at least one of said areas and said select one of said areas as determined by said second determining means.

6. The video game machine according to claim 1, wherein said specific information peculiar to each of said object pieces is a combination of a numeral and a color.

7. The video game machine according to claim 1, further comprising bet input means for enabling the player to input predetermined number of bets by using icons displayed on said display screen including an icon indicative of a first bet unit for input and an icon indicative of a second bit unit for input, wherein said scoring means provides scores dependent on the number of bets input through said bet input means.

8. The video game machine according to claim 7, wherein said first bit unit equals one bet and said second bet unit equals five bets.

9. The video game machine according to claim 1, wherein said specific information of said object marks allocated to said remaining lines by said automatic displaying means includes a portion of information corresponding to a portion of information of the specific information of said corresponding one of the object marks allocated in said corresponding box of said preselected line by the player having used said input displaying means.

10. The video game machine according to claim 9, wherein said portion of information is a color.

11. The video game machine according to claim 10, wherein said specific information of said object marks allocated to said remaining lines by said automatic displaying means includes a numeral related by one of an addition and a subtraction of a given number to and from a numeral of the specific information of said corresponding one of the object marks allocated in said corresponding box of said preselected line.

12. The video game machine according to claim 1, wherein said specific information of said object marks allocated to said remaining lines by said automatic displaying means includes a numeral related by one of an addition and a substraction of a given number to and from a numeral of the specific information of said corresponding one of the object marks allocated in said corresponding box of said preselected line.

13. The video game machine according to claim 3 wherein said bingo card displaying means displays a plurality of said bingo cards.

* * * * *